US011408169B2

(12) United States Patent
Benefield

(10) Patent No.: US 11,408,169 B2
(45) Date of Patent: Aug. 9, 2022

(54) Z-SHAPED BRACKET FOR WOOD BACKING AND FIREPROOFING

(71) Applicant: Cretice Benefield, Auburn, AL (US)

(72) Inventor: Cretice Benefield, Auburn, AL (US)

( * ) Notice: Subject to any disclaimer, the term of this patent is extended or adjusted under 35 U.S.C. 154(b) by 1 day.

(21) Appl. No.: 16/554,817

(22) Filed: Aug. 29, 2019

(65) Prior Publication Data

US 2019/0383007 A1 Dec. 19, 2019

Related U.S. Application Data

(63) Continuation-in-part of application No. 15/823,629, filed on Nov. 28, 2017, now Pat. No. 10,655,326.

(60) Provisional application No. 62/724,605, filed on Aug. 29, 2018.

(51) Int. Cl.
*E04B 2/72* (2006.01)

(52) U.S. Cl.
CPC ..... *E04B 2/721* (2013.01)

(58) Field of Classification Search
CPC ..... E04B 2/562; E04B 2/58; E04B 2103/04; E04B 2002/7485
See application file for complete search history.

(56) References Cited

U.S. PATENT DOCUMENTS 274,354 A * 3/1883 McCarthy et al. ..... E04F 15/10 52/591.4
1,971,010 A * 8/1934 Korn ..... E04F 13/10 52/541
2,691,341 A * 10/1954 Williams ..... B41F 17/26 101/208
3,661,688 A * 5/1972 Wheeler ..... B27N 3/06 264/293
4,084,996 A * 4/1978 Wheeler ..... B32B 37/10 144/368
4,586,309 A * 5/1986 Ferguson ..... E04D 1/265 52/553
4,640,857 A * 2/1987 Hasegawa ..... B32B 21/14 428/537.1
5,059,472 A * 10/1991 Le Bell ..... B32B 21/13 144/132
5,527,103 A * 6/1996 Pittman ..... A47B 47/042 312/265.5
5,906,082 A * 5/1999 Counihan ..... E04F 15/203 52/480
6,049,987 A * 4/2000 Robell ..... E04C 2/043 33/566
6,529,799 B1 * 3/2003 Paulk, Jr. ..... B65C 7/001 700/227
6,705,056 B2 * 3/2004 Tollenaar ..... E04B 2/7457 52/696

(Continued)

*Primary Examiner* — Brian E Glessner
*Assistant Examiner* — Adam G Barlow
(74) *Attorney, Agent, or Firm* — Jeffrey C. Watson; Grell & Watson Patent Attorneys LLC

(57) ABSTRACT

A z-shaped bracket includes a first flange surface, a second flange surface and a connecting web surface. The first flange surface has a plurality of holes therethrough. The connecting web surface connects the first flange surface and the second flange surface at an offset distance. Where the second flange surface is parallel with the first flange surface and is offset the offset distance from the first flange surface. Wherein, the bracket is configured for installing wood blocking between metal studs.

1 Claim, 33 Drawing Sheets

(56) References Cited

U.S. PATENT DOCUMENTS 7,086,205 B2 * 8/2006 Pervan ..... E04F 15/02 52/480
7,520,100 B1 * 4/2009 Herrman ..... E04B 2/7457 52/27
8,005,329 B2 * 8/2011 Shimizu ..... G02B 6/1221 385/39
8,141,319 B2 * 3/2012 Brady ..... E04B 2/7457 52/713
8,268,110 B2 * 9/2012 Pien ..... E04B 5/026 156/196
8,828,175 B2 * 9/2014 Roy ..... B32B 38/0004 156/268
8,950,144 B2 * 2/2015 Padmanabhan .... B62D 25/2054 296/184.1
9,616,650 B2 * 4/2017 Roy ..... B32B 38/0004
9,988,098 B2 * 6/2018 Padmanabhan ..... B32B 21/042
2002/0110664 A1 * 8/2002 Seidner ..... B32B 21/08 428/192
2005/0210827 A1 * 9/2005 Schwartz ..... E04B 1/7654 52/782.1
2007/0137779 A1 * 6/2007 Mori ..... B29C 65/1635 156/272.8
2007/0245656 A1 * 10/2007 Klamer ..... E04B 2/7457 52/317
2009/0113838 A1 * 5/2009 Paulsen ..... B32B 21/08 52/653.1
2013/0014464 A1 * 1/2013 Risi ..... B62D 25/2054 52/592.1
2013/0180198 A1 * 7/2013 Olson ..... E04F 13/18 52/591.4
2015/0075901 A1 * 3/2015 Beresowski ..... E04B 9/045 181/290
2016/0097228 A1 * 4/2016 Wypych ..... E05D 15/0652 49/506

* cited by examiner

Z-SHAPED BRACKET FOR WOOD BACKING AND FIREPROOFING

CROSS-REFERENCE TO RELATED APPLICATIONS

To the full extent permitted by law, this application claims priority benefit of U.S. Provisional Application No. 62/724,605 filed on Aug. 29, 2018 entitled "Z-Shaped Bracket for Wood Backing and Fireproofing". The present application is also a Continuation-in-Part to U.S. patent application Ser. No. 15/823,629 filed on Nov. 28, 2017 entitled "Wood Blocking Blank for Creating Wood Blocking for Metal Studs and Methods of Manufacture and Use Thereof". The foregoing are incorporated by reference as though set forth in their entirety.

FIELD OF THE DISCLOSURE

The present disclosure generally relates to blocking, and specifically, to wood blocking for metal studs and methods of manufacture and use thereof. More specifically, the present disclosure relates to a z-shaped bracket for wood blocking and fireproofing.

BACKGROUND

Generally speaking, blocking is a term for the use of short pieces (blocks) of dimensional lumber in framed construction. Uses may include filling, spacing, joining, or reinforcing members, and fireproofing. Blocking may typically be made from short off-cuts or defective, warped pieces of lumber. Blocking is also sometimes used by people in construction with the sense of a shim or spacer. Names for similar materials in other forms of English include dwang, nog, noggin, and nogging. Some blocking is used structurally like cross bracing between joists in a subfloor to prevent buckling and stiffen the floor. This use is also called block bridging, solid bridging, and solid strutting. Fire-blocking is a firestop. Blocks may be spacers between studs such as where an interior wall attaches an exterior wall and for framing corners such as a three-stud corner with blocking. Blocking may also be used for panel edge supports such as sheets of drywall or plywood also called back blocking.

Although the disclosure is not limited thereto, the blocking described herein, may be particularly useful for backing, also referred to as grounds. This type of blocking refers to pieces of wood or other material that run between wall studs in order to provide support and attachment sites for mounted hardware or trim such as cabinets, shelving, handrails, vanity tops without a cabinet underneath, bathroom towel bars, moldings, the like, etc. Properly installed blocking is easier to find for attaching wall hardware than studs alone. Once drywall, or any other material, covers the wall it can be difficult to find 2*x*4 studs for attachment, and the position of nails and screws must be adjusted to stud location. Thus, if blocking is installed at a uniform and predetermined height, attachment sites can be found without using a stud finder, and the blocking can be utilized anywhere along a wall at that height. This is particularly useful for installing upper cabinets in kitchens or bathrooms as they tend to be heavy and finding appropriate studs for installation can be difficult.

Currently, the practice of installing wood blocking for backing in metal studs, like in commercial construction, is a time-consuming process that requires the installers to make their own blocking. This is obviously very labor intensive and requires not only skilled labor, but also special tools, including power equipment, thereby requiring electricity to be run to the installation location. As such, there is clearly a need to provide wood blocking, and a method of manufacturing and installing thereof, that is quicker and easier to install.

In addition, because blocking may typically be created from scrap wood, or short off-cuts or defective, warped pieces of lumber, the quality and reliability of the backing may be inconsistent and/or weak. This may be especially problematic for providing backing for high weight applications, like handicap railing, and/or for providing backing for applications requiring specific rating, like fire rated materials. As such, there is clearly a need for a better quality and more reliable wood blocking material.

Furthermore, attaching wood blocking to metal studs is difficult because of the shape and material of the metal studs. As such, there is clearly a need for a product and/or method to make attaching wood blocking to metal studs easier and more reliable.

The instant disclosure of a z-shaped bracket for wood backing and fireproofing may be designed to address at least certain aspects of the problems discussed above.

SUMMARY

Briefly described, in a possibly preferred embodiment, the present disclosure overcomes the above-mentioned disadvantages and meets the recognized need for such an apparatus or method by providing of a z-shaped bracket for wood backing and fireproofing. The z-shaped bracket may generally include a bracket having a first flange surface, a second flange surface and a connecting web surface. The first flange surface may have a plurality of holes therethrough. The connecting web surface may connect the first flange surface and the second flange surface at an offset distance, where the second flange surface may be parallel with the first flange surface and may be offset the offset distance from the first flange surface. Wherein, the bracket may be configured for installing wood blocking between metal studs.

In select embodiments of the disclosed z-shaped bracket, the plurality of holes may be punched through the first flange surface. The plurality of holes may be configured for pre-installing the bracket on the metal stud. The first flange surface may be positioned on an outer flange of the metal stud. The connecting web surface may be positioned against a hard side of the metal stud. And the second flange surface may extend approximately perpendicular from the hard side of the metal stud. The second flange surface may be configured for attachment to the wood blocking.

In select embodiments of the disclosed z-shaped bracket, the plurality of holes through the first flange surface may include a first vertical row and a second vertical row. The first vertical row of holes may be positioned approximate a web side of the first flange surface. The second vertical row of holes may be positioned approximate a distal side of the first flange surface. Wherein, the combination of the first vertical row of holes and the second vertical row of holes may be configured for increasing shear strength and pullout strength of the wood blocking. In select embodiments, the first vertical row of holes may include three holes, and the second vertical row of holes may include three holes. In this embodiment, the bracket may be made from a light gauge metal, wherein the light gauge metal may be 20 gauge metal. In addition, in this embodiment, the first flange surface may have a width of 1.25 inches configured to fit on an outer flange of a 1.25 inch wide metal stud. In other select embodiments, the first vertical row of holes may include five holes, and the second vertical row of holes may include five holes. In this embodiment, the bracket may be made from a light gauge metal, wherein the light gauge metal may be 16 gauge metal. In addition, in this embodiment, the first flange surface may have a width of 1.75 inches configured to fit on an outer flange of a structural stud.

One feature of the disclosed z-shaped bracket for wood blocking may be that the offset distance of the connecting web surface may be approximately a thickness of the wood blocking. Accordingly, the first flange surface may be oriented at a slightly acute angle to the connecting web surface, and the second flange surface may be oriented at the same slightly acute angle to the connecting web surface. Whereby, the combination of the first flange surface, the connecting web surface and the second flange surface being formed at the slightly acute angle create a z-shape configured for not allowing interference of a square edge of the blocking at a radius bend of the z-shaped bracket. In select embodiments, the slightly acute angle may be 89 degrees or approximately 89 degrees.

Another feature of the disclosed z-shaped bracket for wood blocking may be that the bracket can be made from a light gauge metal. In select embodiments, the light gauge metal may be equal to or greater than 10 gauge metal. In select possibly preferred embodiments, the light gauge metal may be between 12 gauge metal and 24 gauge metal. In other possibly most preferred embodiments, the light gauge metal material of the z-shaped bracket may be 20 gauge metal or 16 gauge metal.

In another aspect, the instant disclosure embraces a wood blocking system. the wood blocking system may generally include wood blocking placed between metal studs via the disclosed z-shaped bracket in any of the various embodiments shown and/or described herein. As a result, the wood blocking system may include a panel of a blocking material having a standard width. The standard width of the panel of the blocking material may be sized to a nominal stud width configured to fit between the metal studs. The metal studs may include a first metal stud and an adjacent metal stud. Each of the first metal stud and the adjacent metal stud may be c-channel metal studs including a hard side including a flat web. The z-shaped bracket of the wood blocking system may include a bracket having a first flange surface, a second flange surface and a connecting web surface. The first flange surface may have a plurality of holes therethrough. The connecting web surface connects the first flange surface and the second flange surface at an offset distance. The second flange surface may be parallel with the first flange surface and may be offset the offset distance from the first flange surface. Wherein, the z-shaped bracket may be configured to secure the panel of blocking material between the metal studs.

In select embodiments of the wood blocking system disclosed herein, the plurality of holes may be punched through the first flange surface. The plurality of holes may be configured for pre-installing the bracket on the metal stud. The first flange surface may be positioned on an outer flange of the metal stud. The connecting web surface may be positioned against the hard side of the metal stud. And the second flange surface may extend approximately perpendicular from the hard side of the metal stud. The second flange surface may be configured for attachment to the wood blocking.

In select embodiments of the disclosed wood blocking system, the plurality of holes through the first flange surface of the z-shaped bracket may include a first vertical row and a second vertical row. The first vertical row of holes may be positioned approximate a web side of the first flange surface. The second vertical row of holes may be positioned approximate a distal side of the first flange surface. Wherein, the combination of the first vertical row of holes and the second vertical row of holes may be configured for increasing shear strength and pullout strength of the wood blocking.

One feature of the disclosed wood blocking system may be that the offset distance of the connecting web surface may be approximately a thickness of the wood blocking. The first flange surface may be oriented at a slightly acute angle to the connecting web surface, and the second flange surface may be oriented at the same slightly acute angle to the connecting web surface. Whereby, the combination of the first flange surface, the connecting web surface and the second flange surface being formed at the same slightly acute angles create a z-shape configured for not allowing interference of a square edge of the blocking at a radius bend of the z-shaped bracket.

In another aspect, the instant disclosure embraces a method of installing wood blocking between metal studs. In general, the disclosed method may include installing wood blocking between metal studs via the disclosed z-shaped bracket in any of the various embodiments shown and/or described herein. As such, the disclosed method of installing wood blocking may include the steps of: providing a panel of wood blocking material for placement between the metal studs, the panel of wood blocking material having an original length and a standard width. where the standard width being sized to a nominal stud width configured to fit between the metal studs; providing the z-shaped bracket in any of the various embodiments shown and/or described herein; and attaching the panel of wood blocking material between the metal studs with fasteners and the z-shaped bracket.

In select embodiments of the method of installing wood blocking between metal studs disclosed herein, the plurality of holes are punched through the first flange surface, wherein the step of attaching the panel of wood blocking material between the metal studs with fasteners and the z-shaped bracket may include the steps of: pre-installing the bracket on the metal stud, where the first flange surface is positioned on an outer flange of the metal stud, the connecting web surface is positioned against the hard side of the metal stud, and the second flange surface extends approximately perpendicular from the hard side of the metal stud; and attaching the wood blocking panel to the second flange surface.

In other select embodiments of the method of installing wood blocking between metal studs, the method may further include installing two wood blocking panels end to end between the metal studs via the z-shaped bracket. This step of installing two wood blocking panels end to end between the metal studs via the z-shaped bracket may include the steps of: attaching one of the two wood blocking panels to the first flange surface of the bracket; and attaching the other of the two wood blocking panels to the second flange surface of the bracket, where the two wood blocking panels are positioned end to end.

In other select embodiments of the method of installing wood blocking between metal studs, the method may further include installing two wood blocking panels on top of one another via two z-shaped brackets. This step of include installing two wood blocking panels on top of one another via two z-shaped brackets may include the steps of: pre-installing one of the two z-shaped brackets on the metal stud, where the first flange surface is positioned on an outer flange of the metal stud, the connecting web surface is positioned against the hard side of the metal stud, and the second flange surface extends approximately perpendicular from the hard side of the metal stud; positioning the other of the two z-shaped brackets on the metal stud, where the first flange surface is positioned on an inner flange of the metal stud, the connecting web surface is positioned against the hard side of the metal stud, and the second flange surface extends approximately perpendicular from the hard side of the metal stud adjacent to the second flange surface of the other z-shaped bracket; positioning the two wood blocking panels on top of one another with the second flange surfaces of each of the two z-shaped brackets pancaked therebetween; and attaching the two wood blocking panels to the second flange surfaces of each of the two z-shaped brackets.

In other select embodiments of the method of installing wood blocking between metal studs, the method may further include installing two wood blocking panels on each side of a metal stud via two z-shaped brackets. This step of installing two wood blocking panels on each side of a metal stud via two z-shaped brackets may include the steps of: pre-installing one of the two z-shaped brackets on the metal stud, where the first flange surface is positioned on an outer flange of the metal stud, the connecting web surface is positioned against the hard side of the metal stud, and the second flange surface extends approximately perpendicular from the hard side of the metal stud; pre-installing the other of the two-z-shaped brackets on the metal stud, where the first flange surface is positioned over the first flange surface of the other z-shaped bracket on the outer flange of the metal stud, the connecting web surface is positioned against a soft side of the metal stud, and the second flange surface extends approximately perpendicular from the soft side of the metal stud; attaching one of the two wood blocking panels to the second flange surface of one of the two z-shaped brackets; and attaching the other of the two wood blocking panels to the second flange surface of the other of the two z-shaped brackets.

The foregoing illustrative summary, as well as other exemplary objectives and/or advantages of the disclosure, and the manner in which the same are accomplished, may become more apparent to one skilled in the art from the prior Summary, and the following Brief Description of the Drawings, Detailed Description, and Claims when read in light of the accompanying Detailed Drawings.

BRIEF DESCRIPTION OF THE DRAWINGS

The present apparatuses, systems and methods will be better understood by reading the Detailed Description with reference to the accompanying drawings, which are not necessarily drawn to scale, and in which like reference numerals denote similar structure and refer to like elements throughout, and in which:

FIG. 35A shows the z-shaped brackets first connected to the composite deck, FIG. 35B shows the fire proofing and/or acoustic spray applied to the composite deck with the z-shaped brackets attached, and FIG. 35C shows how the metal studs are connected to the z-shaped brackets via a track;

Figures 1, 1A:
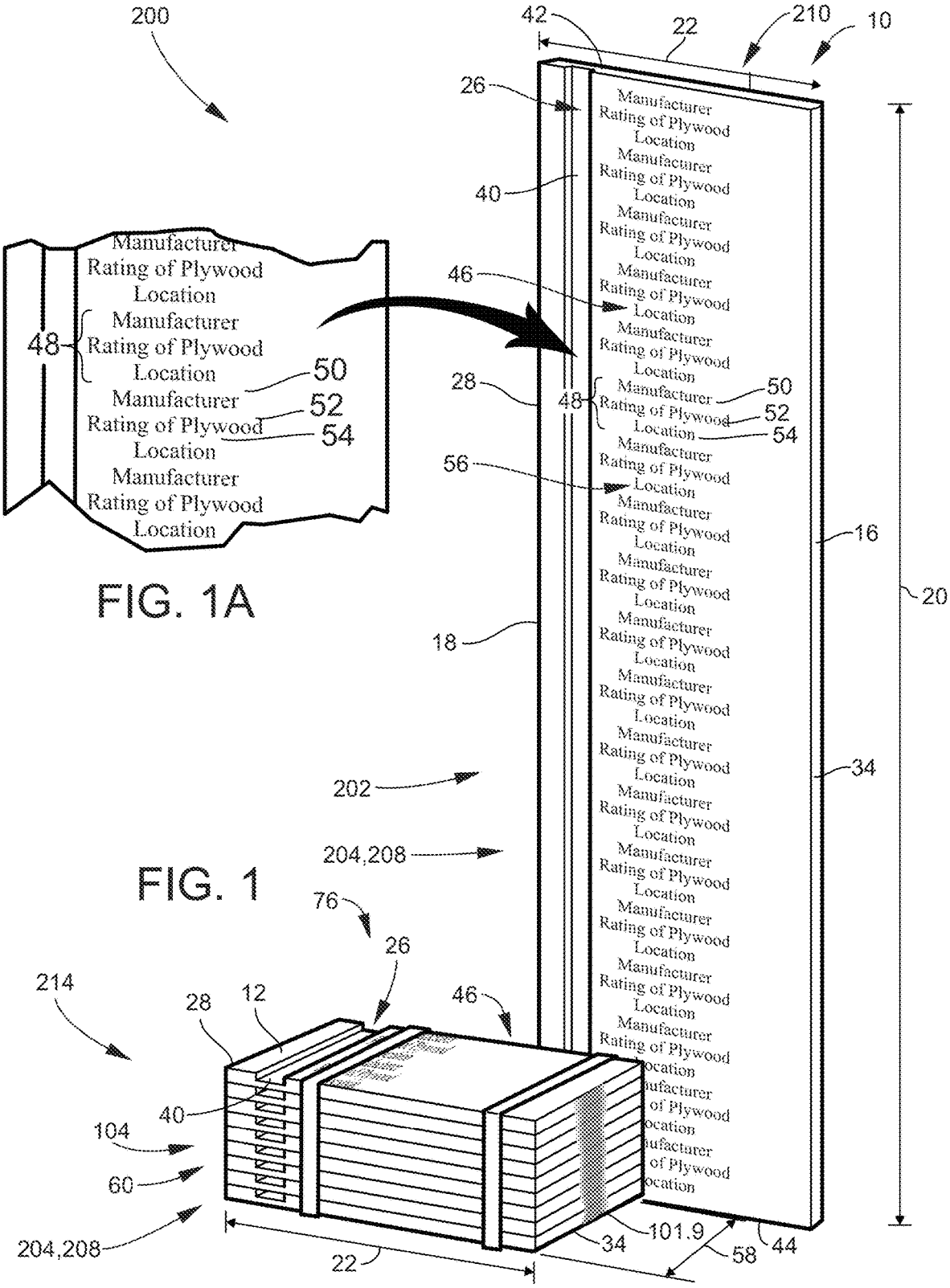
FIG. 1 schematically depicts a top perspective view of a wood blocking blank for creating wood blocking for placement between metal studs according to select embodiments with a bundle of wood blocking created from the wood blocking blank by cutting it into ninths.
FIG. 1A schematically depicts a zoomed in front view of the wood blocking blank from FIG. 1 showing the repeated information according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-38, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-10, in a possibly preferred embodiment, the present disclosure overcomes the above-mentioned disadvantages and meets the recognized need for such an apparatus or method by providing of wood blocking blank 10 for creating wood blocking 12 for placement between metal studs 14 (see FIGS. 4-10). The wood blocking blank 10 includes panel 16 of blocking material 18. Panel 16 of blocking material 18 may be any desired type of blocking material, including any plywood, composites or the like. In select possibly preferred embodiments, the blocking material 18 may include fire-retardant-treated plywood. This fire-retardant-treated plywood may include plywood impregnated with chemicals to meet building code. As an example, panel 16 of blocking material 18 may be plywood with Pyro-Guard® provided by Hoover Treated Wood Products, Inc. of McDuffie County, Ga. The panel 16 of blocking material 18 may have any desired size, including any desired length and/or width. In select embodiments, the panel 16 of blocking material 18 may have original length 20 and standard width 22. The standard width 22 may be sized to nominal stud width 24 (see FIGS. 4-10) configured to fit between the metal studs 14.

Groove 26 may be included in panel 16 of blocking material 18. Groove 26 may be cut down the entire original length 20 of the panel 16 of blocking material 18 approximate first side 28 of the panel 16 of blocking material 18. Groove 26 may be cut into wood blocking blank 10 to make sure that each wood blocking 12 cut or made from wood blocking blank 10 includes groove 26 so that each wood blocking 12 can be oriented and mounted between metal studs 14. By cutting groove 26 into blank 10, prior to making each wood blocking 12, not only are a lot of time and resources saved (1 cut versus multiple cuts), but also the groove can be more consistent from one wood blocking 12 to the next. The groove 26 may be configured for orienting the first side 28 of the panel 16 of blocking material 18, or blocking 12 created therefrom, in soft side 30 of a first metal stud 32 and a second side 34 of the panel 16 of blocking material 18, or blocking 12 created therefrom, against the hard side 36 of an adjacent metal stud 35 (see FIGS. 4-10). The groove 26 may be sized to receive lip 38 of soft side 30 of the first metal stud 32. In select embodiments, the groove 26 may be cut in the wood blocking blank 10 may be a through dado 40 running the entire original length 20 of the panel 16 of blocking material 18. The through dado 40 may run across grain from top edge 42 to bottom edge 44. As an example, and clearly not limited thereto, the through dado 40 may be approximately 0.3 inches deep by 0.75 inches wide along the entire original length 20 of the panel 16 of blocking material 18. In select embodiments, the groove 26 may be cut approximately 1.5 inches at its center from the first side 28 of the panel 16 of blocking material 18.

Continuous stamp 46 may be included as one feature of the wood blocking blank 10 disclosed herein. Continuous stamp 46 may be applied or printed on wood blocking blank 10 to make sure that each wood blocking 12 cut or made from wood blocking blank 10 includes the origination information of each wood blocking 12 made therefrom, like the desired information of what, where, how, ingredients, rating etc. wood blocking 12 was made. Continuous stamp 46 may be included at any position on panel 16 of blocking material 18. Continuous stamp 46 may be positioned along the entire original length 20 of the panel 16 of blocking material 18. The continuous stamp 46 may include repeated information 48 of the blocking material 18 that is configured to be visible on each piece of blocking 12 created from the panel 16 of blocking material 18. In select embodiments, the repeated information 48 of the continuous stamp 46 along the entire original length 20 of the blocking material 18 may include, but is not limited to, manufacturer 50, rating of blocking material 52 (i.e. treated, fire retardant, etc.), and location 54 (i.e. where the blocking material 18 was manufactured). The continuous stamp 46 may be configured so that each piece of blocking 12 created from the panel 16 of blocking material 18 may include at least manufacturer 50, rating of blocking material 52, and location 54. In select embodiments, the continuous stamp 46 may be positioned approximate the groove 26 of the panel 16 of blocking material 18 in horizontal orientation 56. Whereby, the continuous stamp 46 may be configured to be visible when installed between the metal studs 14 for inspection. By placing the continuous stamp 46 approximate the groove 26, the blocking 12 may be cut at the second side 34 for various widths of metal studs 14, where the continuous stamp 46 may still be visible even when the blocking 12 is cut.

The wood blocking blank 10 disclosed herein may be that the original length 20 of the panel 16 of blocking material 18 may be configured to be cut to a desired height 58 of blocking 12 or left at the original length 20. In select embodiments, the original length 20 of the panel 16 of blocking material 18 may be configured to be cut in ninths 60, eighths 62, sevenths 64, sixths 66, fifths 68, fourths 70, thirds 72, halves 74, combinations thereof, or left at the original length 20. See FIGS. 1-2. As examples, and clearly not limited thereto, when the original length 20 is 48 inches, the cut lengths may be: approximately 5 and ⅛ inches when cut in ninths 60; approximately 5 and ⅞ inches when cut in eighths 62; approximately 6 and ¾ inches when cut in sevenths 64; approximately 7 and ⅞ inches when cut in sixths 66; approximately 9 and ½ inches when cut in fifths 68; approximately 11 and ¾ inches when cut in fourths 70; approximately 15 and ¾ inches when cut in thirds 72; approximately 23 and ⅞ inches when cut in halves 74; and approximately 48 inches when left at original length 20. As such, when the original length is 48 inches and the standard width 22 is 15.75 inches, which is sized to the nominal stud width 24 between the metal studs 14 of 16 inches, the example blockings created may be, but are not limited to: a number five blocking 76 of approximately 5 and ⅛ inches by 15.75 inches when cut in ninths 60; a number six blocking 78 of approximately 5 and ⅞ inches by 15.75 inches when cut in eighths 62; a number seven blocking 80 of approximately 6 and ¾ inches by 15.75 inches when cut in sevenths 64; a number eight blocking 82 of approximately 7 and ⅞ inches by 15.75 inches when cut in sixths 66; a number ten blocking 84 of approximately 9 and ½ inches by 15.75 inches when cut in fifths 68; a number twelve blocking 86 of approximately 11 and ¾ inches by 15.75 inches when cut in fourths 70; a number sixteen blocking 88 of approximately 15 and ¾ inches by 15.75 inches when cut in thirds 72; a number twenty-four blocking 90 of approximately 23 and ⅞ inches by 15.75 inches when cut in halves 75; and a number forty-eight blocking 92 of approximately 48 inches by 15.75 inches when left at original length 20. Other examples include, but are not limited thereto, when the original length 20 is 48 inches and the standard width 22 is 11.75 inches, 13.25 inches, 15.75 inches, 19.05 inches, or 23.75 inches being sized to the nominal stud width 24 between the metal studs of 12 inches, 13.5 inches, 16 inches, 19.2 inches or 24 inches, respectively, the blockings created may be: approximately 5 and ⅛ inches by 11.75 inches, 13.25 inches, 15.75 inches, 19.05 inches, or 23.75 inches, when cut in ninths 60; approximately 5 and ⅞ inches by 11.75 inches, 13.25 inches, 15.75 inches, 19.05 inches, or 23.75 inches, when cut in eighths 62; approximately 6 and ¾ inches by 11.75 inches, 13.25 inches, 15.75 inches, 19.05 inches, or 23.75 inches, when cut in sevenths 64; approximately 7 and ⅞ inches by 11.75 inches, 13.25 inches, 15.75 inches, 19.05 inches, or 23.75 inches, when cut in sixths 66; approximately 9 and ½ inches by 11.75 inches, 13.25 inches, 15.75 inches, 19.05 inches, or 23.75 inches, when cut in fifths 68; approximately 11 and ¾ inches by 11.75 inches, 13.25 inches, 15.75 inches, 19.05 inches, or 23.75 inches, when cut in fourths 70; approximately 15 and ¾ inches by 11.75 inches, 13.25 inches, 15.75 inches, 19.05 inches, or 23.75 inches, when cut in thirds 72; approximately 23 and ⅞ inches by 11.75 inches, 13.25 inches, 15.75 inches, 19.05 inches, or 23.75 inches, when cut in halves 74; and approximately 48 inches by 11.75 inches, 13.25 inches, 15.75 inches, 19.05 inches, or 23.75 inches, when left at original length 20. Although the disclosure is directed toward even cuts down the original length 20 of panel 16 of blocking material 18, the disclosure is not so limited, and various lengths, or combination of lengths, may be cut from wood blocking blank 10, like one blocking 12 of ½ the original length 20, and 2 blockings 12 of ¼ of the original length 20, and so forth.

Another feature of the wood blocking blank 10 disclosed herein may be that the blank 10 and/or blocking 12 created therefrom may be combined to create longer lengths. As an example, and clearly not limited thereto, a 48 inch blank 10 and a 24 inch blocking 12 may be combined for a total length of 72 inches, like for a toilet partition. As another example, an 8 inch blocking 12 may be combined with a 5 inch blocking 12 for a total length of 13 inches. Z-shaped brackets 93 may be included between panel to panel connections for easier assembly.

Figure 2:
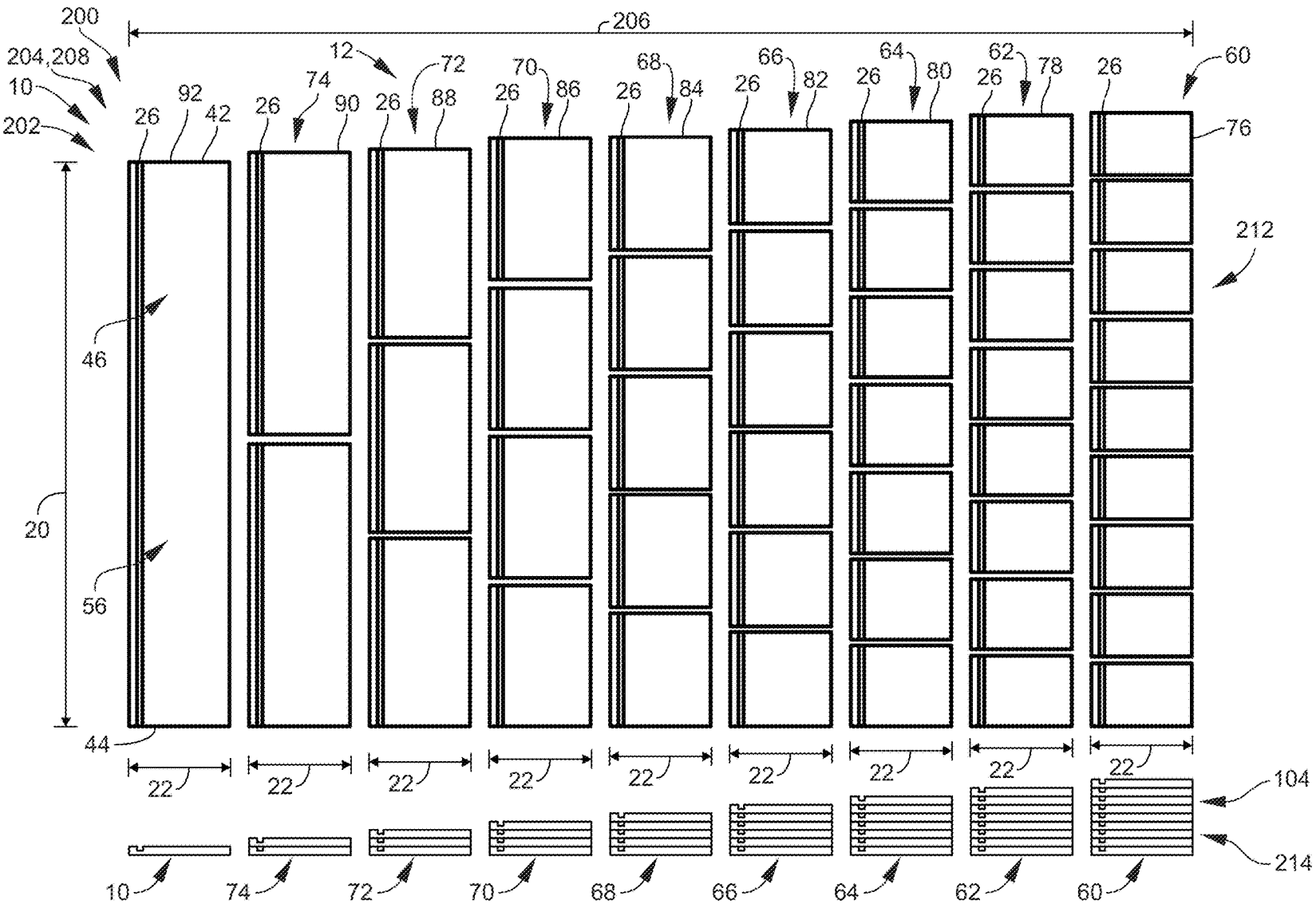
FIG. 2 schematically depicts a front view of various embodiments of wood blocking blank from FIG. 1 being left at the original length, cut in halves, thirds, fourths, fifths, sixths, sevenths, eighths, and ninths, and a bottom view of each respective bundle depicted below.

Referring to FIGS. 1-2, bundles 104 may be created from wood blocking 12 cut from wood blocking blank 10. Each bundle 104 may include the number of wood blocking 12 cut from wood blocking blank 10. As such, as shown in FIGS.

1-2, each bundle may include: a single wood blocking 12 when panel 16 of blocking material 18 is left at its original length 20; two wood blockings 12 when panel 16 of blocking material 18 is cut in halves 74 with a length of original length 20 divided by 2; three wood blockings 12 when panel 16 of blocking material 18 is cut in thirds 72 with a length of original length 20 divided by 3; four wood blockings 12 when panel 16 of blocking material 18 is cut in fourths 70 with a length of original length 20 divided by 4; five wood blockings 12 when panel 16 of blocking material 18 is cut in fifths 68 with a length of original length 20 divided by 5; six wood blockings 12 when panel 16 of blocking material 18 is cut in sixths 66 with a length of original length 20 divided by 6; seven wood blockings 12 when panel 16 of blocking material 18 is cut in sevenths 64 with a length of original length 20 divided by 7; eight wood blockings 12 when panel 16 of blocking material 18 is cut in eighths 62 with a length of original length 20 divided by 8; and nine wood blockings 12 when panel 16 of blocking material 18 is cut in ninths 60 with a length of original length 20 divided by 9. As a result, the total weight of each bundle 104 will be approximately equal to the weight of the blank 10. In addition, the total square footage that each bundle will cover will be approximately equal to the square footage of the blank 10. As such, each bundle 104 purchased or required may be easily used for a commercial estimate for calculating labor and material. However, the disclosure is not limited to just be cut into ninths or less, as 10ths, $11^{th}$, 12ths, 13ths, etc. may be desired. For example, if blank 10 is 96 inches, of if there is a 10 foot sheet of blocking material 12 by five feet wide, the blank 10 may clearly be cut in more pieces of blocking 12.

Figure 3A:
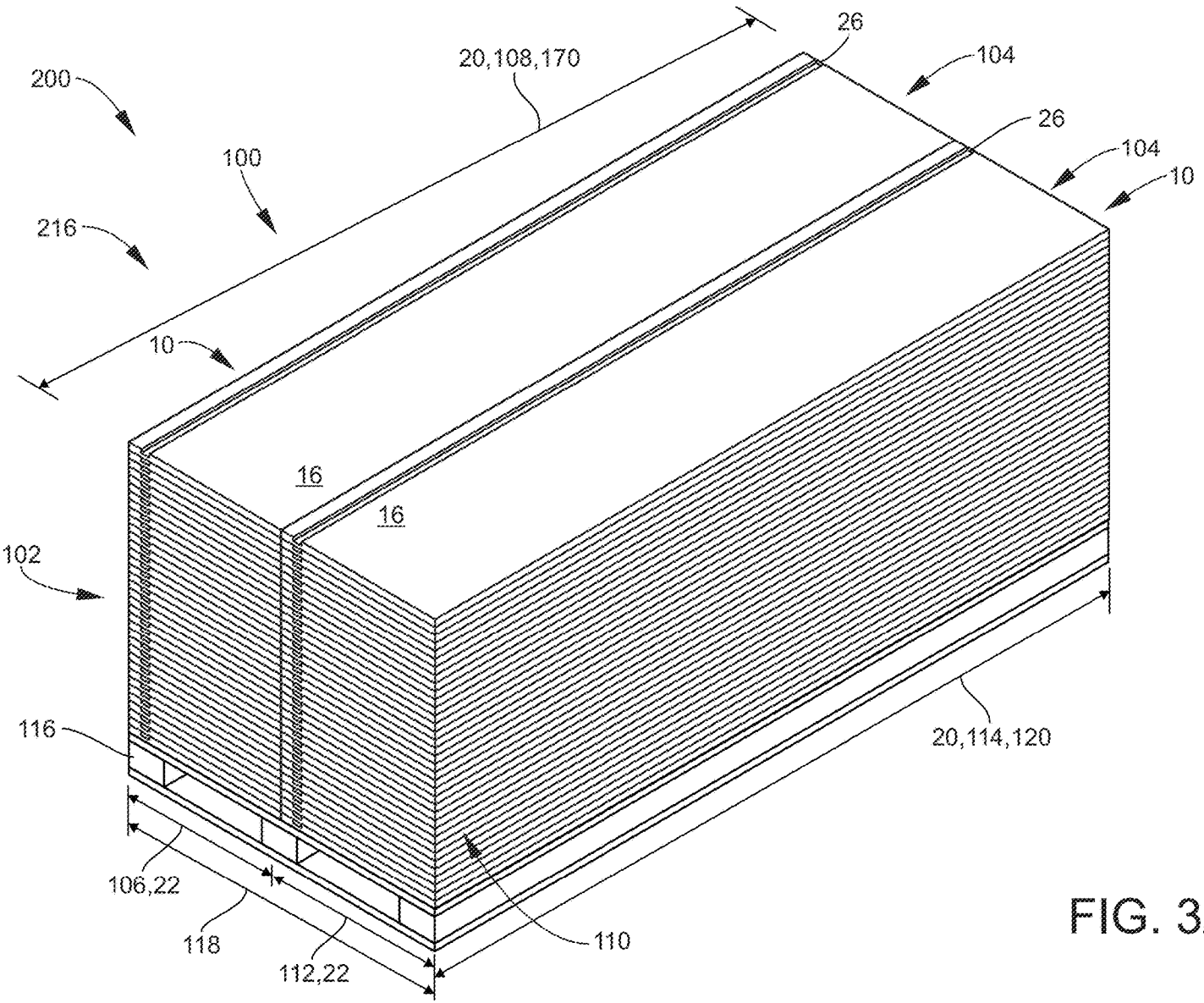
FIG. 3A schematically depicts a top perspective view of a pallet of wood blocking according to select embodiments of the instant disclosure.
Figure 3B:
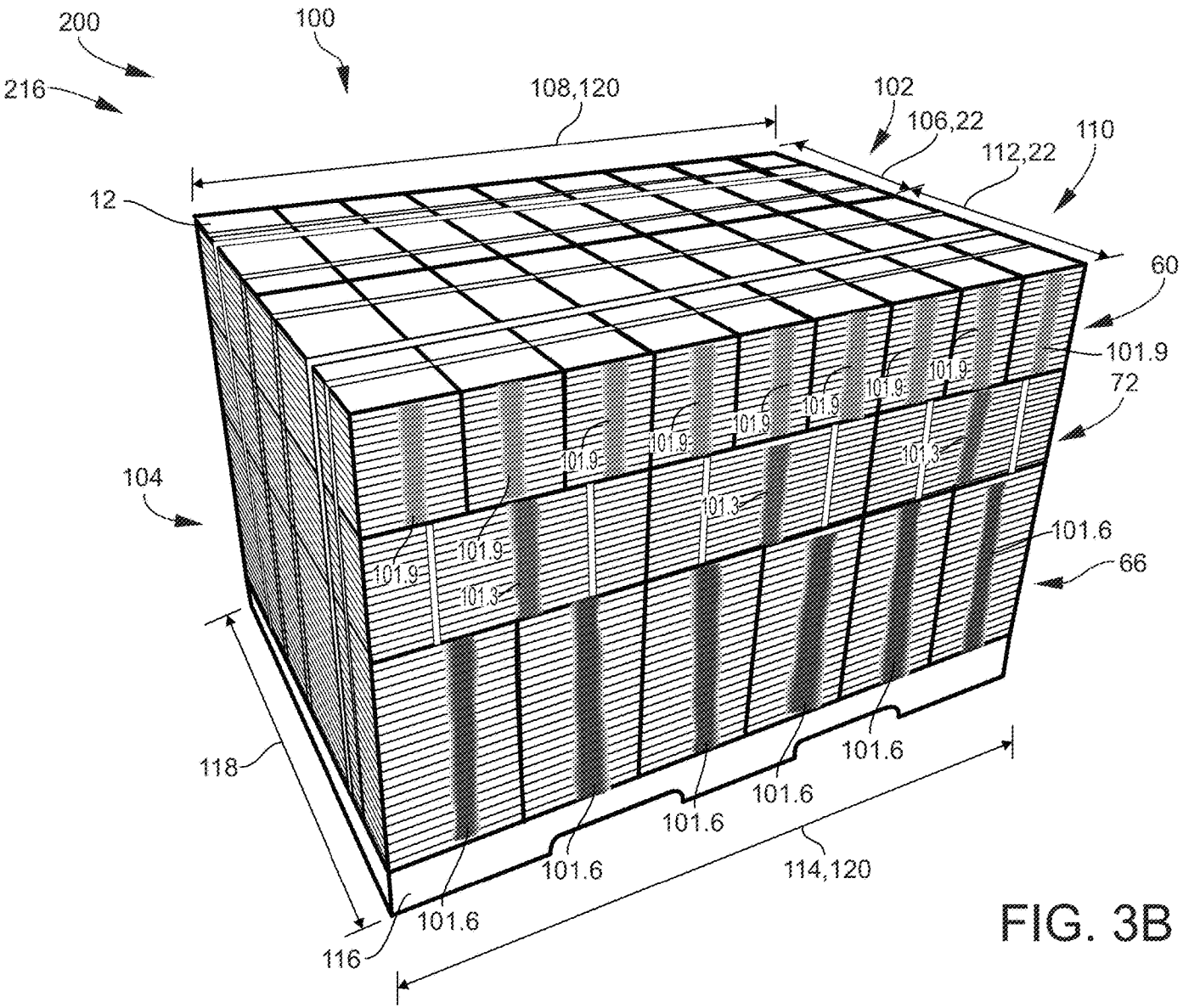
FIG. 3B schematically depicts a top perspective view of another pallet of wood blocking according to select embodiments of the instant disclosure.
Figure 4:
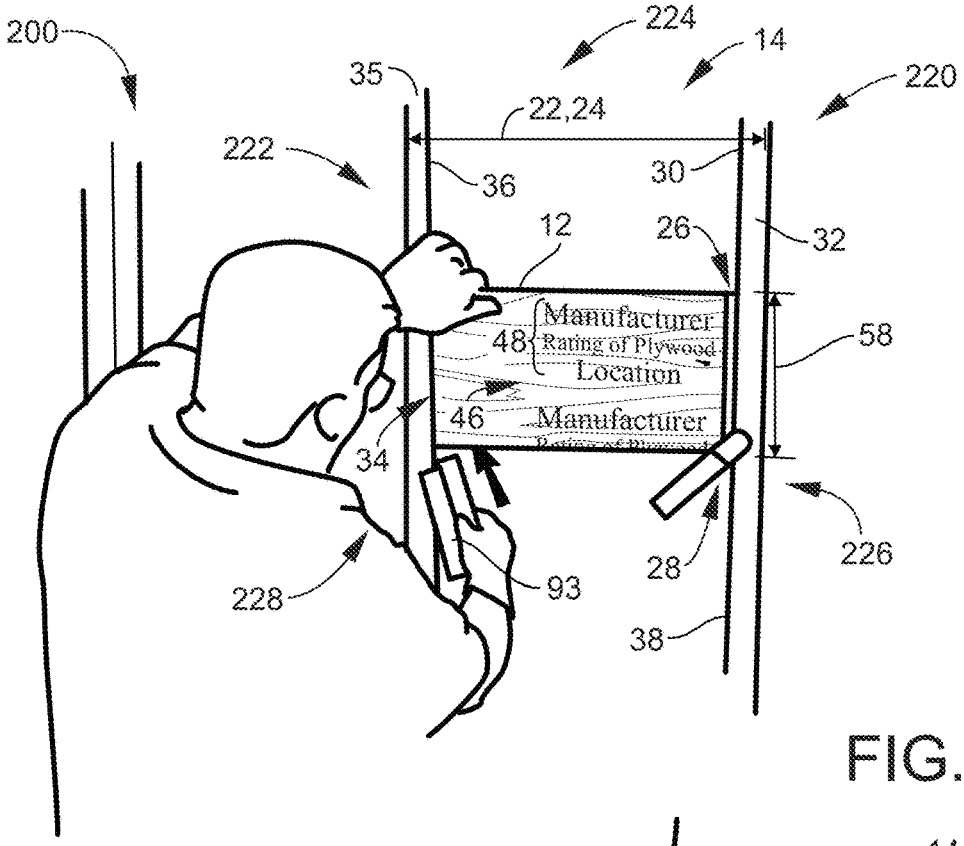
FIG. 4 shows an environmental front view of a wood blocking according to the instant disclosure being positioned for installation between two metal studs.
Figure 5:
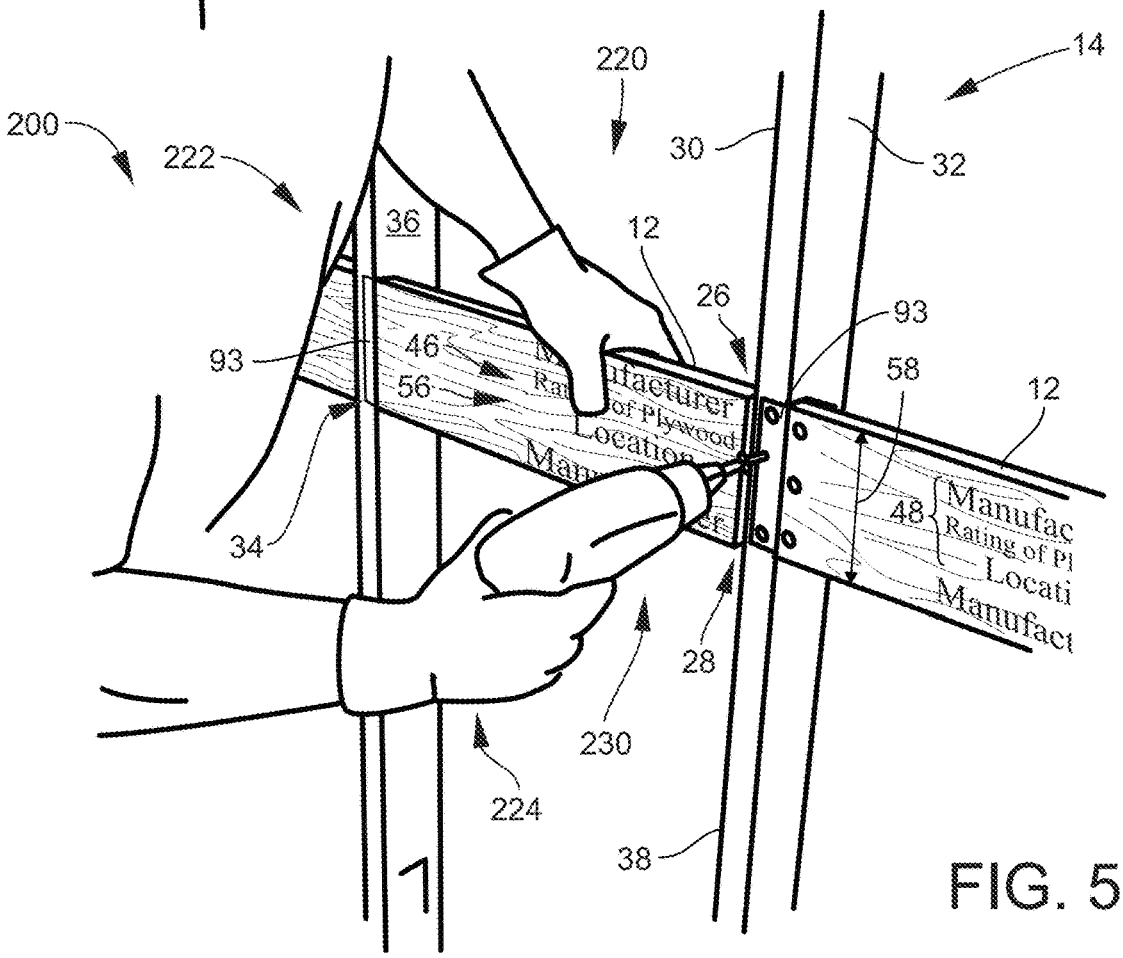
FIG. 5 shows an environmental perspective view of wood blocking according to select embodiments of the instant disclosure being installed between metal studs.
Figure 6:
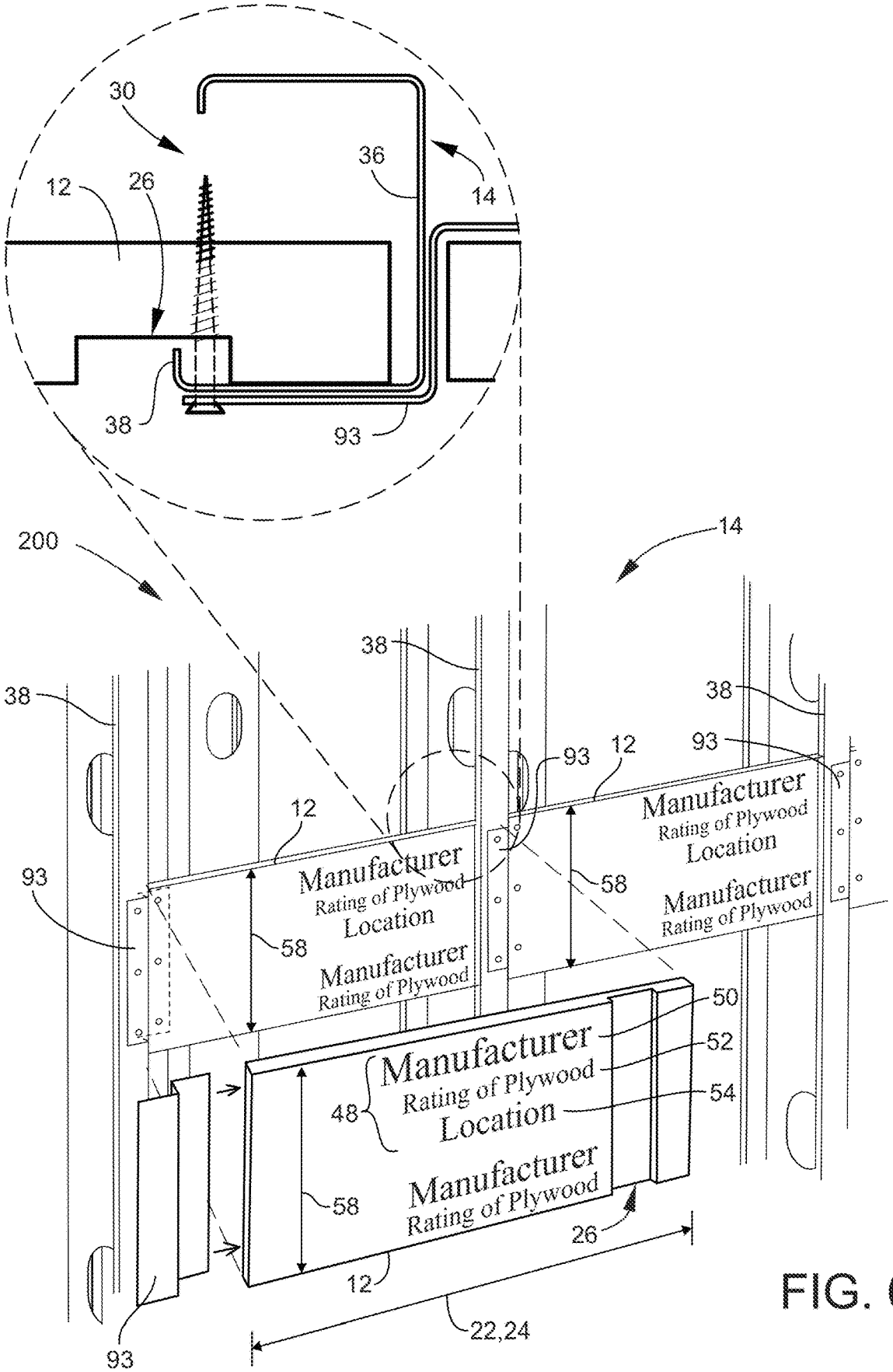
FIG. 6 shows an environmental perspective view of wood blocking according to select embodiments of the instant disclosure being installed between metal studs with z-shaped brackets.
Figure 7:
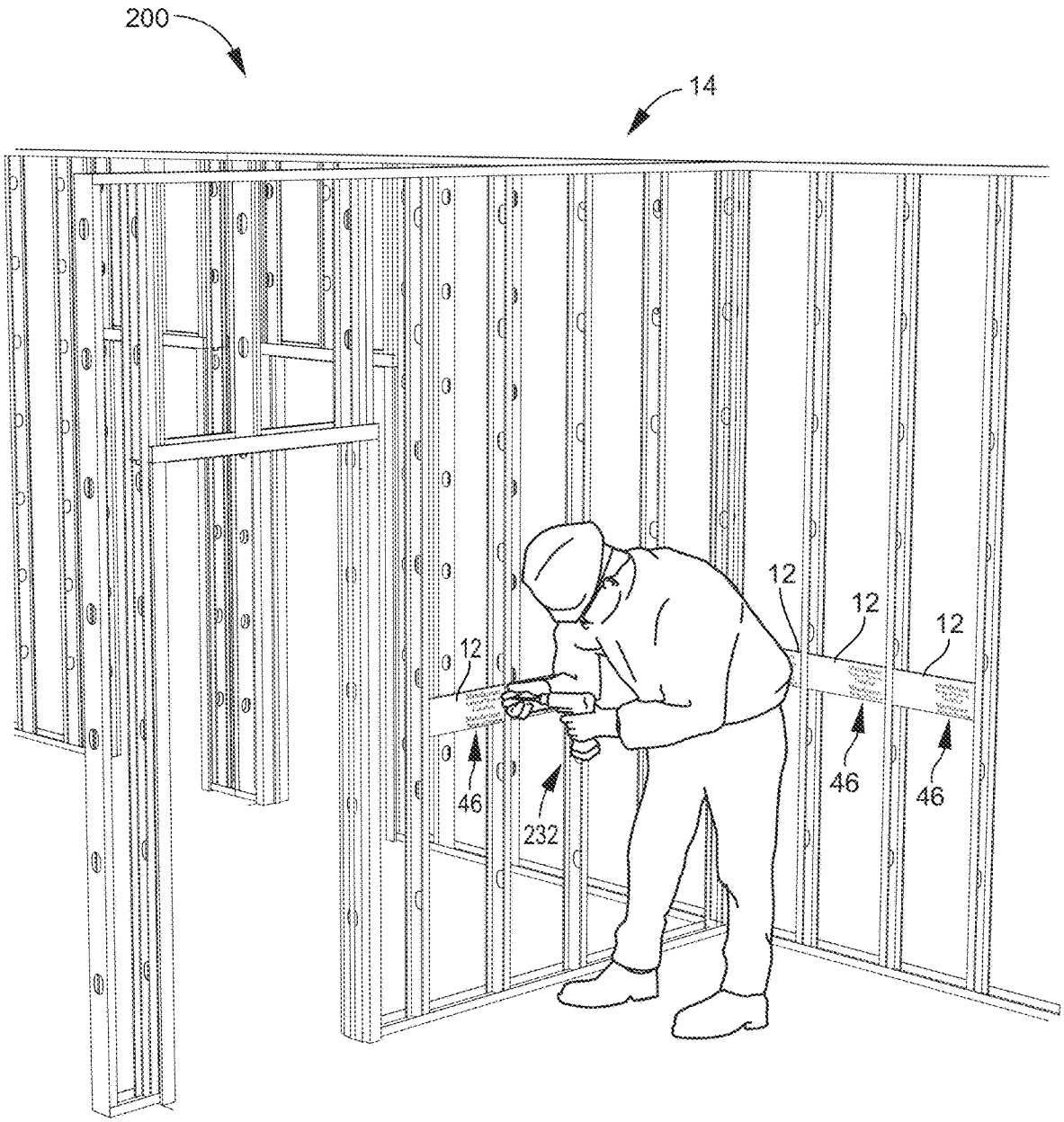
FIG. 7 shows an environmental perspective view of wood blocking according to select embodiments of the instant disclosure being installed between metal studs.
Figure 8:
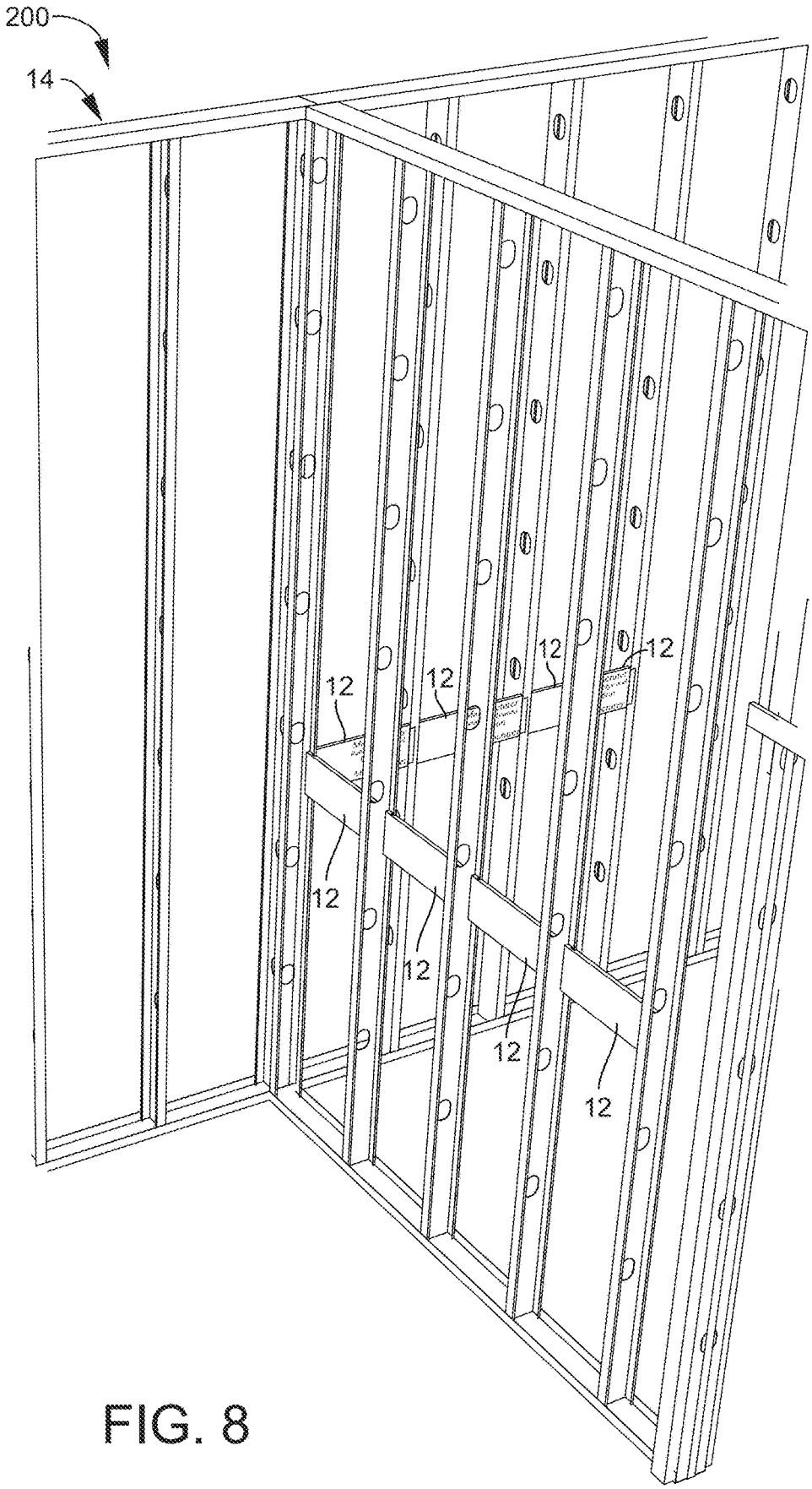
FIG. 8 shows an environmental perspective view of wood blocking according to select embodiments of the instant disclosure installed between metal studs.
Figure 9:
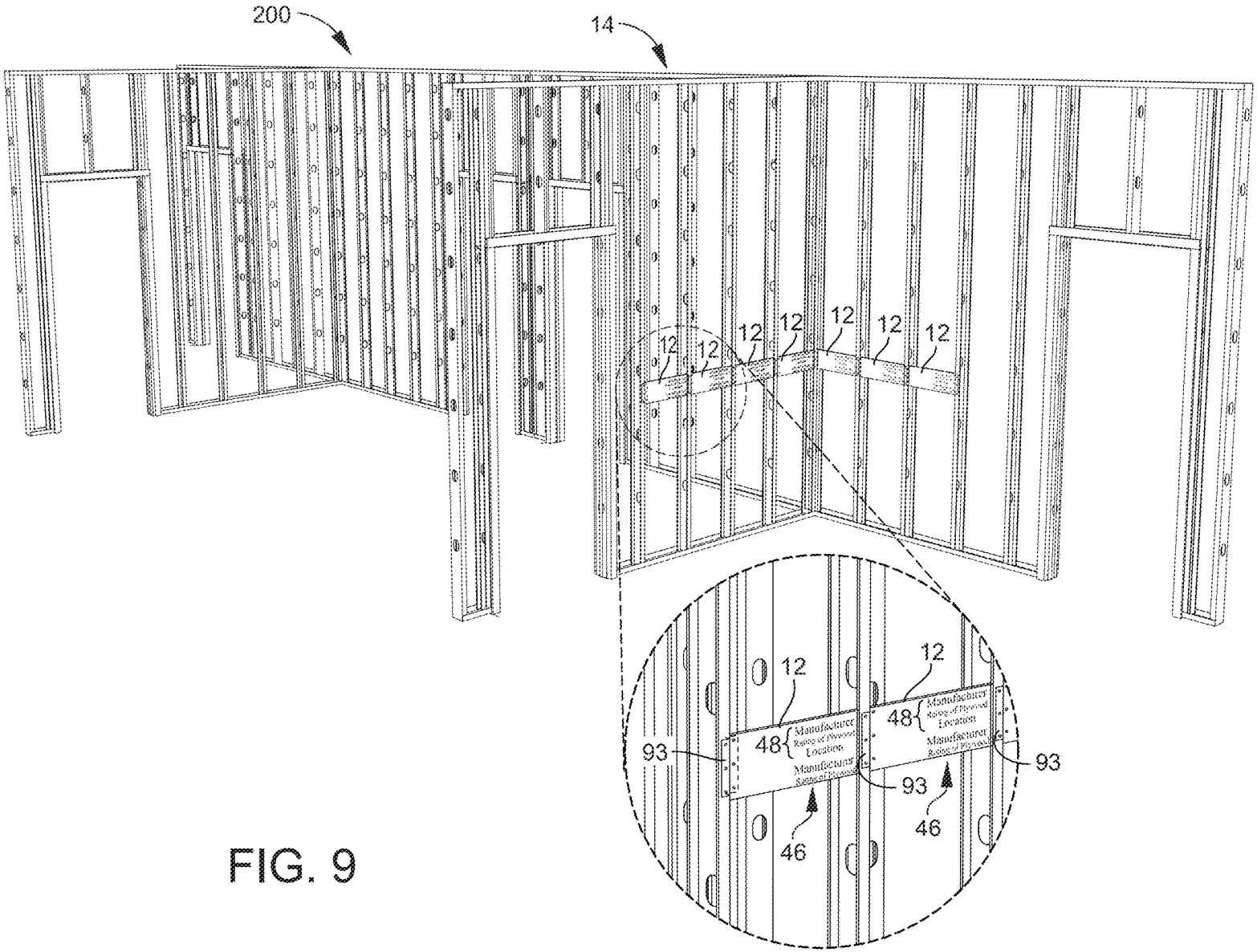
FIG. 9 shows an environmental perspective view of wood blocking according to select embodiments of the instant disclosure installed between metal studs with a zoomed in view showing the continuous stamp on the blockings and the z-shaped brackets used for installation.
Figure 10:
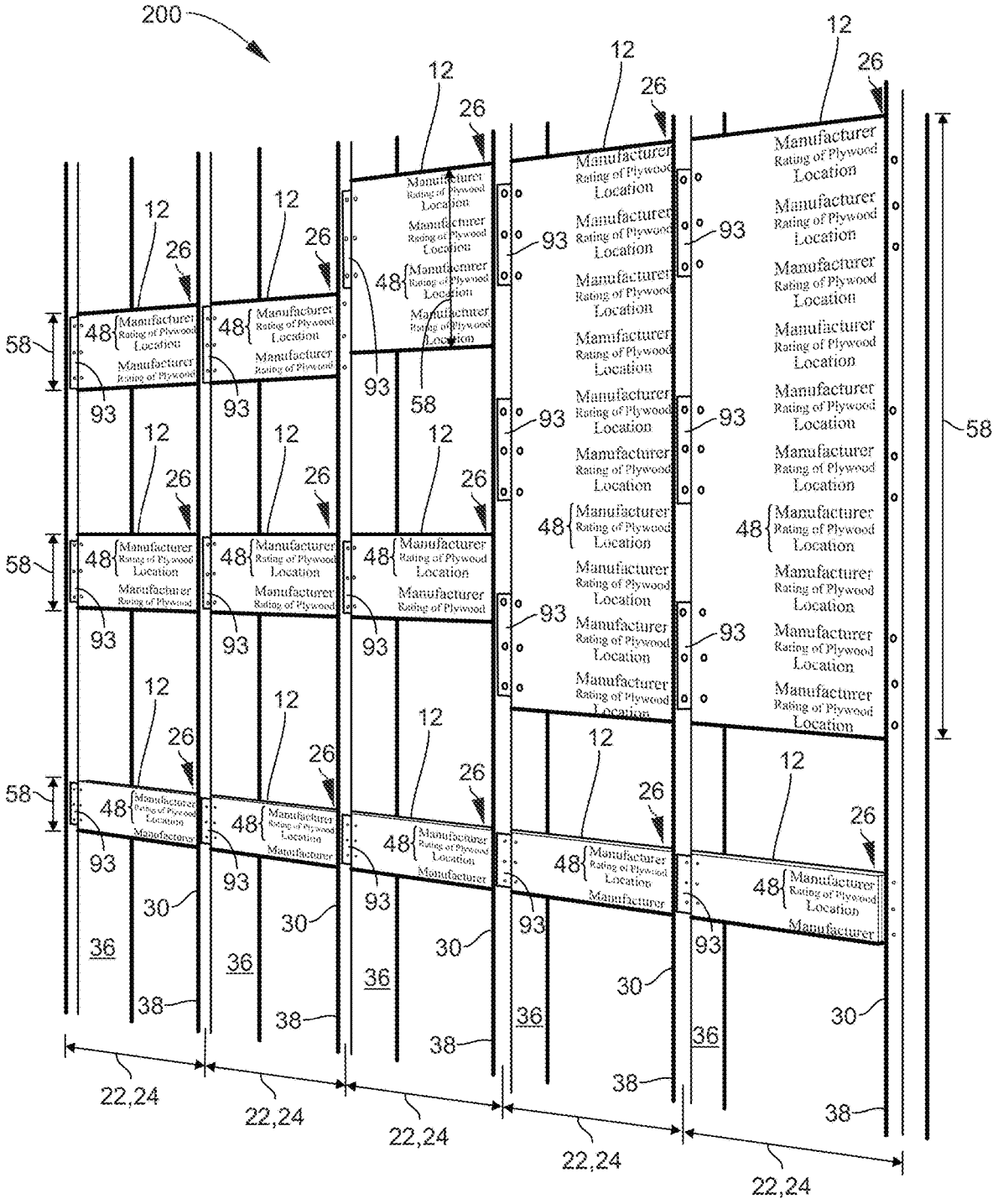
FIG. 10 shows another environmental perspective view of wood blocking according to select embodiments of the instant disclosure installed between metal studs in various sizes.
Figure 11:
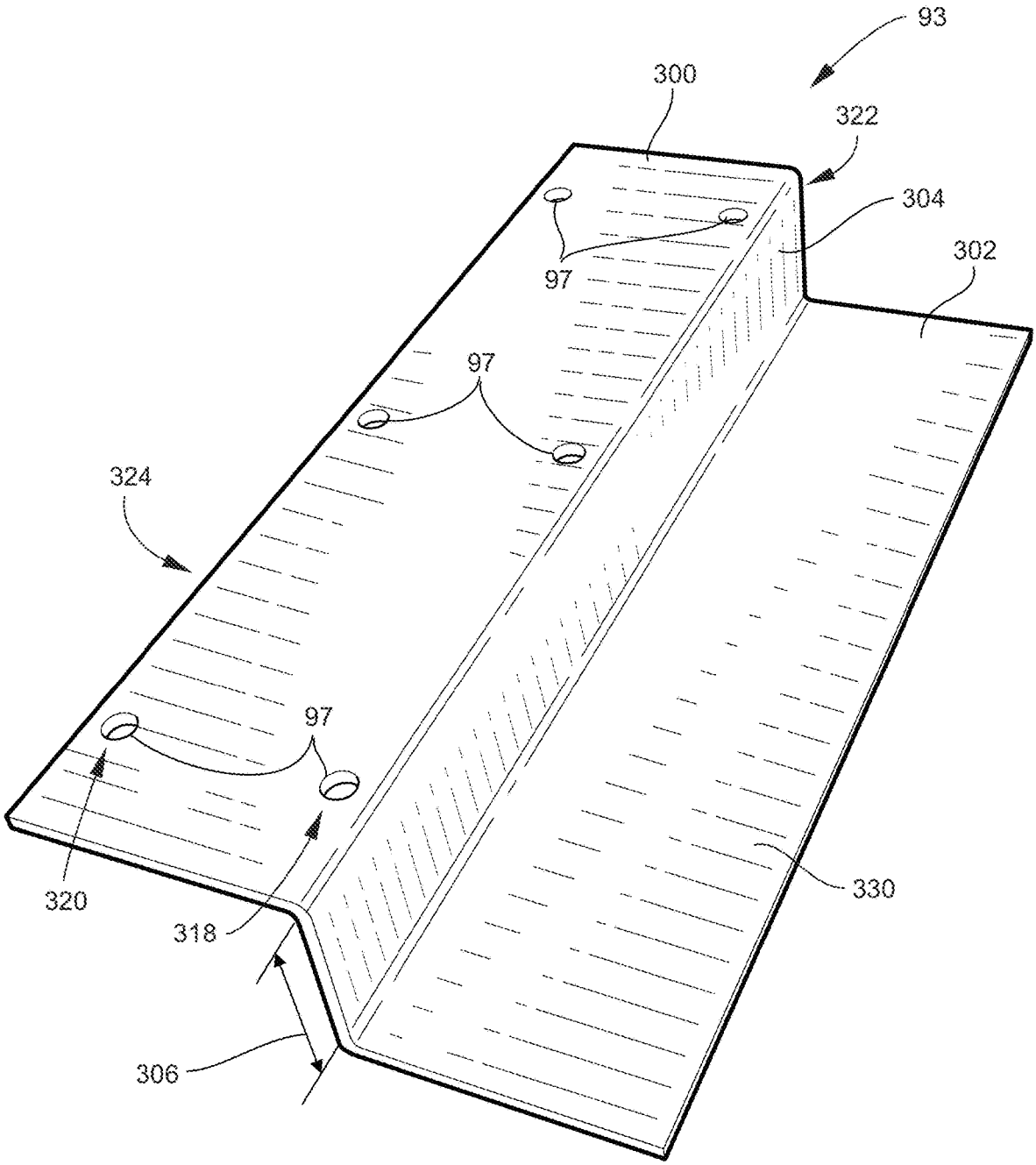
FIG. 11 shows a perspective view of a z-shaped bracket according to select embodiments of the instant disclosure.
Figure 12:
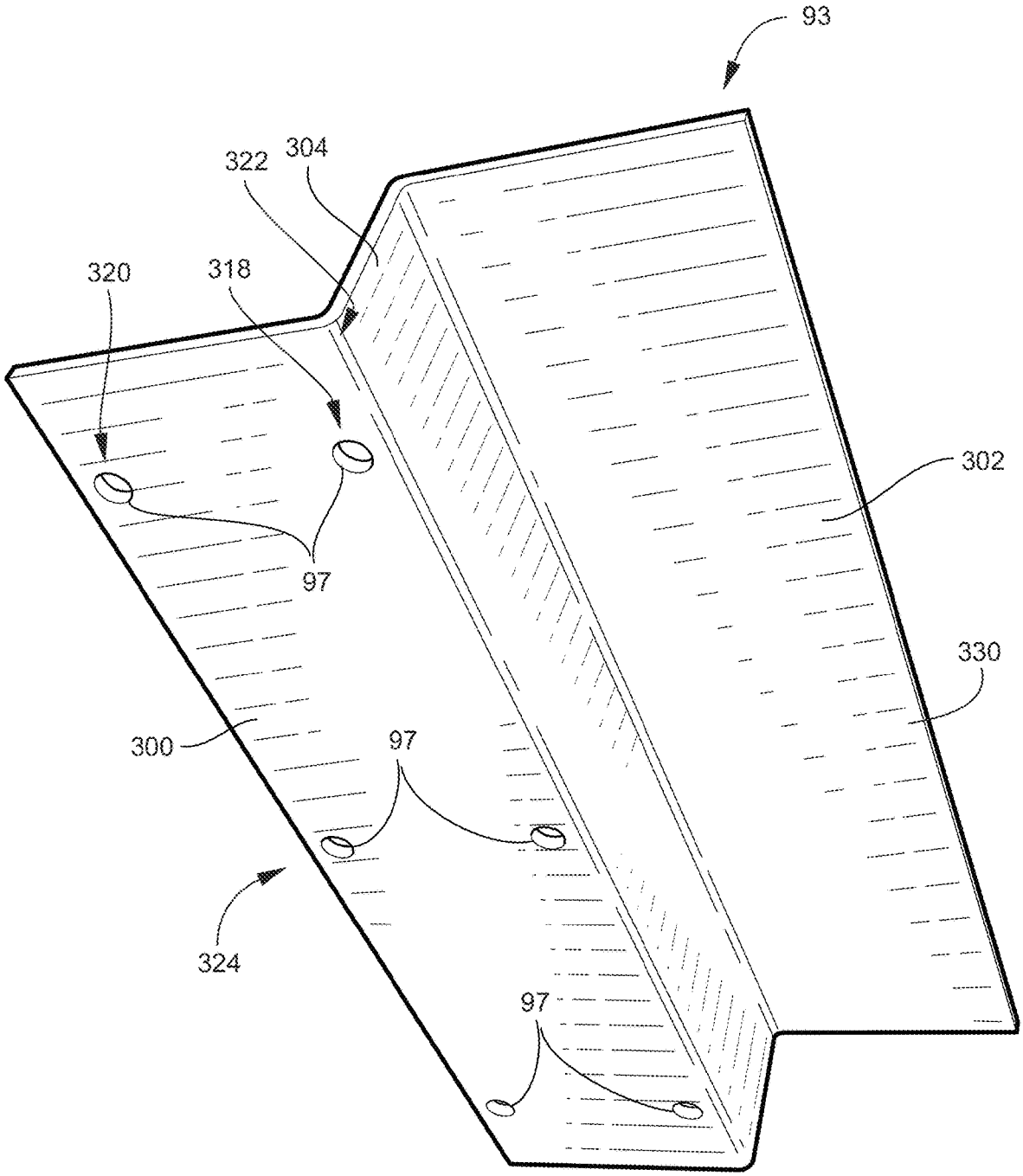
FIG. 12 shows another perspective view of the z-shaped bracket from FIG. 11.
Figure 13:
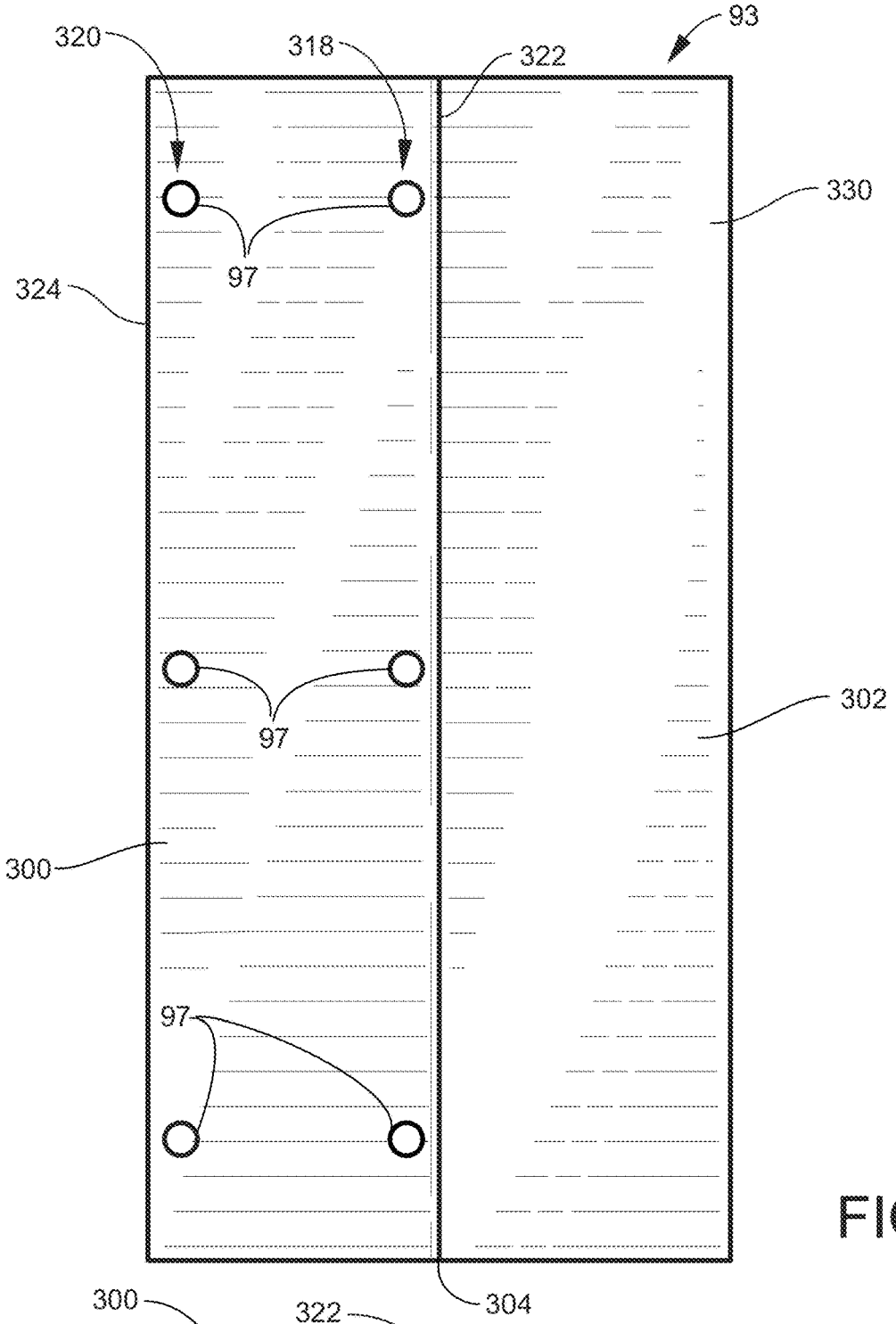
FIG. 13 shows a top view of the z-shaped bracket from FIG. 11.

Referring now to FIGS. 3A and 3B, pallet 100 of wood blocking 12 is shown. Pallet 100 of wood blocking 12 may be created from multiple wood blocking blanks 10 or wood blockings 12 cut therefrom. Pallet 100 of wood blocking 12 may generally include first row 102 of wood blocking bundles 104 (see FIG. 1), second row 110 of wood blocking bundles 104, and base pallet 116. First row 102 of wood blocking bundles 104 on the pallet 100 may have first row width 106 and first row length 108. Likewise, second row 110 of wood blocking bundles 104 on the pallet 100 may have second row width 112 and second row length 114. As such, the base pallet 116 may have pallet width 118 of approximately the first row width 106 plus the second row width 112. The base pallet 116 may also have pallet length 120 of approximately the first row length 108 and/or the second row length 114. Whereby, the base pallet 116 may be configured for supporting the first and second rows 102, 110 of wood blocking bundles 104 side by side.

One feature of the pallet 100 of wood blocking 12 described herein may be that the pallet width 118 may be small enough to allow the pallet 100 of wood blocking 12 to be pulled through a door. This may allow for easy transportation and/or storage of pallet 100 and wood blocking 12 from various locations and jobsites. As an example, when the first row 102 of wood blocking 12 may have first row width 106 of approximately 15.75 inches and the second row 110 of wood blocking may have second row width 112 of approximately 15.75 inches, the pallet width 118 may be approximately 32 inches or less. As such, the pallet width 118 of approximately 32 inches or less may be small enough to allow the pallet 100 of wood blocking 12 to be pulled through a standard 3/0 door (approximately 34.5 inches). In select embodiments of the pallet 100 of wood blocking 12 disclosed herein, the first row 102 of wood blocking bundles 104 may have the first row length 108 being equal to original length 20 of panel 16 of blocking material 18 and first row width 106 of standard width 22 of the panel 16 of blocking material 18, and the second row 110 of wood blocking bundles 104 may have the second row length 114 being equal to the original length 20 of the panel 16 of blocking material 18 and the second row width 112 of the standard width 22 of the panel 16 of blocking material 18. Wherein, the base pallet 116 may have pallet width 118 of twice the standard width 22 of the panel 16 of blocking material 18, and pallet length 120 of the original length 20 of the panel 16 of blocking material 18. Whereby, the base pallet 116 may be configured for supporting the first and second rows 102, 110 of wood blocking bundles 104 side by side.

In select embodiments of the pallet 100 of wood blocking 12 disclosed herein, the first row 102 of wood blocking bundles 104 and the second row 110 of wood blocking bundles 104 may include, but are not limited to: a single blank 10 of the original length 20 of the panel 16 of blocking material 18 (as shown in FIG. 3A); two bundles 104 of the original length 20 of the panel 16 of blocking material 18 cut in halves 74; three bundles 104 of the original length 20 of the panel 16 of blocking material 18 cut in thirds 72 (middle layer of pallet 100 in FIG. 3B); four bundles 104 of the original length 20 of the panel 16 of blocking material 18 cut in fourths 70; five bundles 104 of the original length 20 of the panel 16 of blocking material 18 cut in fifths 68; six bundles of the original length 20 of the panel 16 of blocking material 18 cut in sixths 66 (bottom layer of pallet 100 in FIG. 3B); seven bundles 104 of the original length 20 of the panel 16 of blocking material 18 cut in sevenths 64; eight bundles 104 of the original length 20 of the panel 16 of blocking material 18 cut in eighths 62; nine bundles 104 of the original length 20 of the panel 16 of blocking material 18 cut in ninths 60 (top layer of pallet 100 in FIG. 3B); or combinations thereof that equal the original length 20 of the panel 16 of blocking material 18 (as shown in FIG. 3B).

Referring now specifically to the embodiment of pallet 100 shown in FIG. 3A, first row 102 and second row 110 are each made of a single blank 10 of blanks 10. Each bundle 104 of blanks 10 has 36 blanks 10 for a total of 72 blanks 10 on each pallet 100.

Referring now specifically to the embodiment of pallet 100 shown in FIG. 3B, first row 102 and second row 110 are each made of multiple various bundles 104 of wood blocking 12 created from blanks 10. As shown, the bottom layer includes 6 bundles 104 of the original length 20 of the panel 16 of blocking material 18 cut in sixths 66, the middle layer includes 3 bundles 104 of the original length 20 of the panel 16 of blocking material 18 cut in thirds 72, and the top layer includes 9 bundles 104 of the original length 20 of the panel 16 of blocking material 18 cut in ninths 60. As should be clearly understood, the disclosure is not so limited to the embodiments shown in FIGS. 3A and 3B of pallet 100, and other various combinations of bundles 104 may be created. In select embodiments, pallet 100 may be manufacture with 72 blanks 10. When cut up, we have 72 bundles 104. 1 blank 10 may be equal to 1 bundle 104. The pallet 100 shown in FIG. 3B represents a mixed pallet in which there are 72 bundles of different sizes. Bundles 104 may include color coding 101 (like red, blue, green, yellow, orange, purple, etc.), where a different color is used for each size of blocking 12 in bundles 104. This may include, but is not limited to, 101.9, as shown in FIG. 1 and the top layer in FIG. 3B for bundles 104 of the original length 20 of the panel 16 of blocking material 18 cut in ninth 60, 101.6, as shown in the bottom layer of FIG. 3B for bundles 104 the original length 20 of the panel 16 of blocking material 18 cut in sixths 66, and 101.3, as shown in the middle layer of FIG. 3B of bundles 104 of the original length 20 of the panel 16 of blocking material 18 cut in thirds 72. This color coding 101 may be for supplier/installer to recognize the size difference, as a bundle of wood may look the same if this is not done.

A weight of each bundle 104 may be equal to a nominal weight of the panel of blocking material. As a result, a total weight of the first row 102 of wood blocking 12 and a total weight of the second row 110 of wood blocking 12 may be approximately equal to a row of the panel 16 of blocking material 18. In addition, an area or square footage of each bundle 104 may be equal to a nominal area or square footage of the panel 16 of blocking material 18. As a result, a total volume or cubic footage of the first row 102 of wood blocking 12 and a total volume or cubic footage of the second row 110 of wood blocking may be approximately equal to a row of the panel 16 of blocking material 18. As such, each pallet 100, row 102 and 110, purchased or required may be easily used for a commercial estimate for calculating labor and material.

Referring now to FIGS. 1-10, method 200 of installing wood blocking 12 between metal studs 14 is disclosed herein. Method 200 of installing wood blocking 12 may generally include step 202 of creating wood blocking blank 10 for creating wood blocking 12 for placement between metal studs 14, in any of the various embodiments shown and/or described herein of wood blocking blank 10. See FIGS. 1-2. As a result, the method 200 may include the step 204 of cutting groove 26 down the entire original length 20 of the panel 16 of blocking material 18 approximate first side 28 of panel 16 of blocking material 18. See FIGS. 1-2. The groove 26 may be configured for orienting the first side 28 of panel 16 of blocking material 18, and any wood blocking 12 created or cut therefrom, in soft side 30 of first metal stud 32 and second side 34 of the panel 16 of blocking material 18, and any wood blocking 123 created or cut therefrom, against the hard side 36 of an adjacent metal stud 25. Groove 26 cut in step 204 may be sized to receive lip 38 of the soft side of the metal stud. In addition, method 200 of installing wood blocking 12 between metal studs 14 may include step 206 of cutting the original length 20 of the panel 16 of blocking material 18 to a desired height 58 of wood blocking 12 or leaving the original length 20 of the panel 16 of blocking material 18 at the original length 20 for the desired height 58 of the wood blocking 12.

Step 204 of cutting groove 26 down the entire original length 20 of the panel 16 of blocking material 18 may include step 208 of cutting through dado 40 running the entire original length 20 of the panel 16 of blocking material 18 across grain from top edge 42 to bottom edge 44. The through dado cut in step 208 may be, but is not limited to, approximately 0.3 inches deep by 0.75 inches wide along the entire original length 20 of the panel 16 of blocking material 18. In select embodiments, the center of the groove 26 may be cut a distance from the first side 28 of the panel 16 of blocking material 18 that is approximately a width of the stud flange. As examples, the center of the groove 26 may be cut approximately 1.25", 1.375", 1.625", 2.0", 2.5", 3.0", etc. from the first side 28 of the panel 16, to fit stud flanges with widths of 1.25", 1.375", 1.625", 2.0", 2.5", 3.0", etc. However, the width of the groove may be cut wide enough to receive the lip from multiple size widths of stud flanges. As such, as a first example, when the center of the groove 26 may be cut approximately 1.375" from the first side 28 of the panel 16, the groove may be wide enough to fit stud flanges with widths of 1.25", 1.375", and 1.625". As another example, when the center of the groove 26 may be cut approximately 2.5" from the first side 28 of the panel 16, the groove may be wide enough to fit stud flanges with widths of 2.0", 2.5", and 3.0".

Step 210 of applying continuous stamp 46 along the entire original length 20 of the panel 16 of blocking material 18 may be included in method 200 of installing wood blocking 12 between metal studs 14. The continuous stamp 46 applied in step 210 may be applied with repeated information 48 of the blocking material 18 that is configured to be visible on each piece of blocking 12 created from the panel 16 of blocking material 18. The repeated information 48 of the continuous stamp 46 applied along the entire original length 20 of the blocking material 18 may include, but is not limited to, manufacturer 50, rating of blocking material 52, and location 54, wherein each piece of blocking 12 created from the panel 16 of blocking material 18 may include at least the manufacturer 50, the rating of blocking material 52, and the location 54. The continuous stamp 46 applied in step 210 may be positioned approximate the second side 34 of the panel 16 of blocking material 18 in horizontal orientation 56, whereby the continuous stamp 46 may be configured to be visible when installed between the metal studs 14.

Step 206 of cutting the length 20 of the panel 16 of blocking material 18 to desired height 58 of wood blocking 12 or leaving the length 20 of the panel 16 of blocking material 18 at the original length 20 for the height 58 of the wood blocking 12 may include step 212 of cutting the original length 20 in ninths 60, eighths 62, sevenths 64, sixths 66, fifths 68, fourths 70, thirds 72, halves 74, combinations thereof, or left at the original length 20. See FIGS. 1-2.

Step 214 of bundling the wood blocking 12 into bundles 104 of the wood blocking 12 may be included in method 200 of installing wood blocking 12 between metal studs 14. See FIGS. 1-2.

Step 216 of creating pallet 100 of the wood blocking 12 from the bundles 104 for transportation may be included in select embodiments of method 200 of installing wood blocking 12 between metal studs 14. See FIG. 3.

In select embodiments of the method 200 of installing wood blocking 12 disclosed herein, the method 200 may further include step 218 of putting the wood blocking 12, the bundles 104, the pallet 100 of wood blocking 12, or combinations thereof into a commercial estimate for calculating labor and material.

Referring now to FIGS. 4-10, step 219 of mounting the wood blocking 12 between metal studs 14 may be included in select embodiments of method 200 of installing wood blocking 12 between metal studs 14. This step 219 of mounting the wood blocking 12 between metal studs 14 may include any methods, tools, devices, etc. for mounting wood blocking 12 between metal studs 14. In select embodiments, as shown in the figures, step 219 of mounting the wood blocking 12 between metal studs 14 may include: step 220 of orienting the groove 26 on the first side 28 of the blocking 12 in soft side 30 of first metal stud 32, where lip 38 of the soft side 30 of the metal stud 32 is positioned in the groove 26 (see FIG. 4); step 222 of orienting second side 34 of the blocking 12 against the hard side 36 of adjacent metal stud 35 (see FIG. 4); and step 224 of securing the wood blocking 12 between the metal studs 14 (see FIGS. 5-7). In select embodiments, the step 224 of securing the wood blocking 12 between the metal studs 14 may include: step 226 of clamping the first side 28 of the wood blocking 12 to the soft side 30 of the first metal stud 32 (see FIG. 4); step 228 of clamping the second side 34 of the wood blocking 12 to the hard side 36 of the adjacent metal stud 35 (see FIG. 4); step 230 of attaching the first side 28 of the wood blocking 12 to the soft side 30 of the first metal stud 32 with fasteners, like screws (see FIG. 5); and step 232 of attaching the second side 34 of the wood blocking 12 to the hard side 36 of the adjacent metal stud 35 with fasteners, like screws) and z-shaped bracket 93 (see FIGS. 5, 6, 9 and 10). Z-shaped bracket 93 may be installed by positioning the z-shaped bracket 93 between the second side 34 of the wood blocking 12 and the hard side 36 of the adjacent metal stud 35, and then using fasteners to fasten one side of the z-shaped bracket 93 to the second side 34 of the wood blocking 12 and the other side of the z-shaped bracket 93 to the adjacent metal stud 35. Best shown in FIG. 6.

Referring now to FIGS. 11-30, z-shaped bracket 93 for wood blocking 12 (like wood backing and fireproofing) is shown in various embodiments (also shown in FIGS. 5, 6, 9 and 10). Referring specifically to FIGS. 11-18 and 27, z-shaped bracket 93 may generally include bracket 93 having first flange surface 300, second flange surface 302 and connecting web surface 304. First flange surface 300 may have plurality of holes 97 therethrough. Connecting web surface 304 may connect first flange surface 300 and second flange surface 302 at offset distance 306, where second flange surface 302 may be parallel with first flange surface 300 and may be offset the offset distance 306 from first flange surface 300. Wherein, z-shaped bracket 93 may be configured for installing wood blocking 12 between metal studs 14 (as shown in FIGS. 5, 6, 9, 10, 19-26, and 28-34).

The plurality of holes 97 in first flange surface 300 of z-shaped bracket 93 may be for attaching first flange surface 300 of z-shaped bracket 93 to metal studs 14, or the like. Plurality of holes 97 may be any size, shape, location, or type of holes in first flange surface 300 of z-shaped bracket 93. In select embodiments, plurality of holes 97 may be punched through first flange surface 300, i.e. plurality of holes 97 are punched holes. As an example, and clearly not limited thereto, plurality of holes 97 may have a diameter of 0.13 inches plus or minus 0.02 inches. Plurality of holes 97 may be sized and shaped to fit the desired fasteners 95 and 97 used for attaching or fastening z-shaped brackets 93 to metal studs 14, wood blocking 12, or the like. As such, plurality of holes 97 may be configured for pre-installing z-shaped bracket 93 on metal stud 14. As best shown in FIGS. 20-26, in select embodiments, first flange surface 300 may be positioned on outer flange 310 of metal stud 14. Connecting web surface 304 may be positioned against hard side 36 of metal stud 14. And second flange surface 302 may extend approximately perpendicular from hard side 36 of metal stud 14. Second flange surface 302 may thus be configured for attachment to wood blocking 12 for securing the wood blocking 12 between adjacent metal studs 14.

Plurality of holes 97 through first flange surface 300 may include first vertical row 318 and second vertical row 320. First vertical row 318 of holes 97 may be positioned approximate web side 322 of first flange surface 300. In select embodiments, as an example, and clearly not limited thereto, first vertical row 318 of holes 97 may be positioned 0.18 inches (plus or minus 0.02 inches) from web side 322 of first flange surface 300. In other select embodiments, as another example, and clearly not limited thereto, first vertical row 318 of holes 97 may be positioned 0.25 inches (plus or minus 0.02 inches) from web side 322 of first flange surface 300. Likewise, second vertical row 320 of holes 97 may be positioned approximate distal side 324 of first flange surface 300. In select embodiments, as an example, and clearly not limited thereto, second vertical row 320 of holes 97 may be positioned 0.18 inches (plus or minus 0.02 inches) from distal side 324 of first flange surface 300. In other select embodiments, as another example, and clearly not limited thereto, second vertical row 320 of holes 97 may be positioned 0.25 inches (plus or minus 0.02 inches) from distal side 324 of first flange surface 300. Wherein, the combination of first vertical row 318 of holes 97 and second vertical row 320 of holes 97 may be configured for increasing shear strength 326 and pullout strength 328 of wood blocking 12.

Referring specifically to FIGS. 11-18, in select embodiments, first vertical row 318 of holes 97 may include three of holes 97 equally spaced approximate web side 322, and second vertical row 329 of holes 97 may include three of holes 97 equally spaced approximate distal side 324. In this embodiment, bracket 93 may be made from light gauge metal 330, wherein light gauge metal may be 20 gauge metal. In addition, in this embodiment, first flange surface 300 may have a width of 1.25 inches configured to fit on an outer flange 310 of a 1.25 inch wide metal stud 14.

Figure 27:
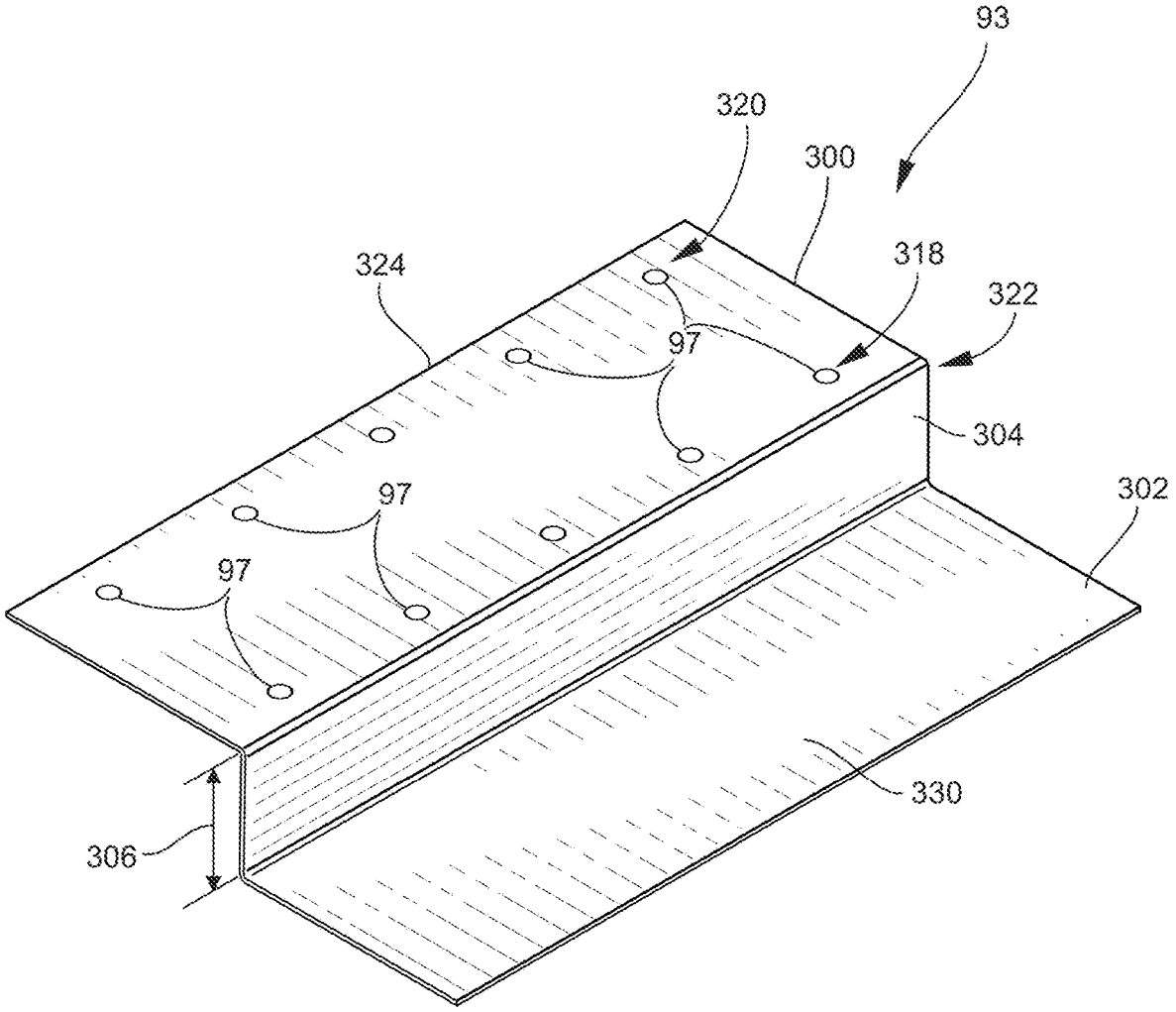
FIG. 27 shows a perspective view of another z-shaped bracket according to select embodiments of the instant disclosure.

Referring now specifically to FIG. 27, in other select embodiments, first vertical row 318 of holes 97 may include five of holes 97 equally spaced approximate web side 322, and second vertical row 320 of holes 97 may include five of holes 97 equally spaced approximate distal side 324. In this embodiment, bracket 93 may be made from light gauge metal 330, wherein light gauge metal 330 may be 16 gauge metal. In addition, in this embodiment, first flange surface 300 may have a width of 1.75 inches configured to fit on an outer flange 310 of a structural stud, as commonly known by one skilled in the art. As such, in this embodiment, z-shaped bracket 93 may be configured for structural uses.

Figure 14:
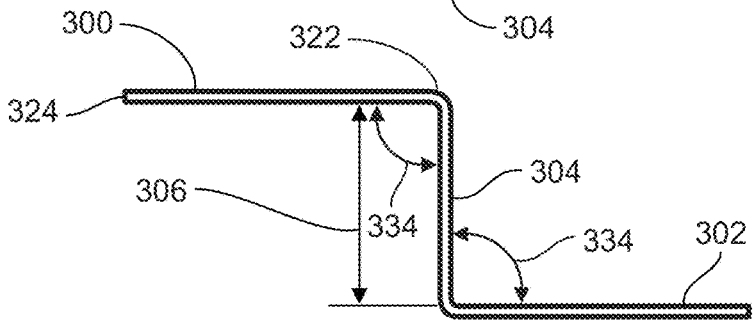
FIG. 14 shows a right side view of the z-shaped bracket from FIG. 11.
Figure 15:
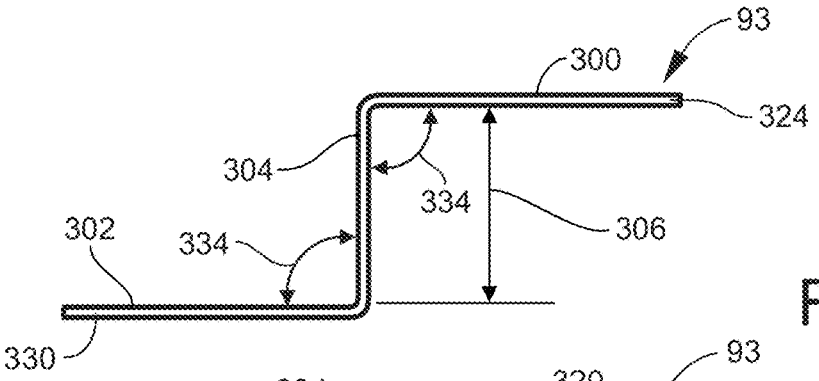
FIG. 15 shows a left side view of the z-shaped bracket from FIG. 11.
Figure 16:
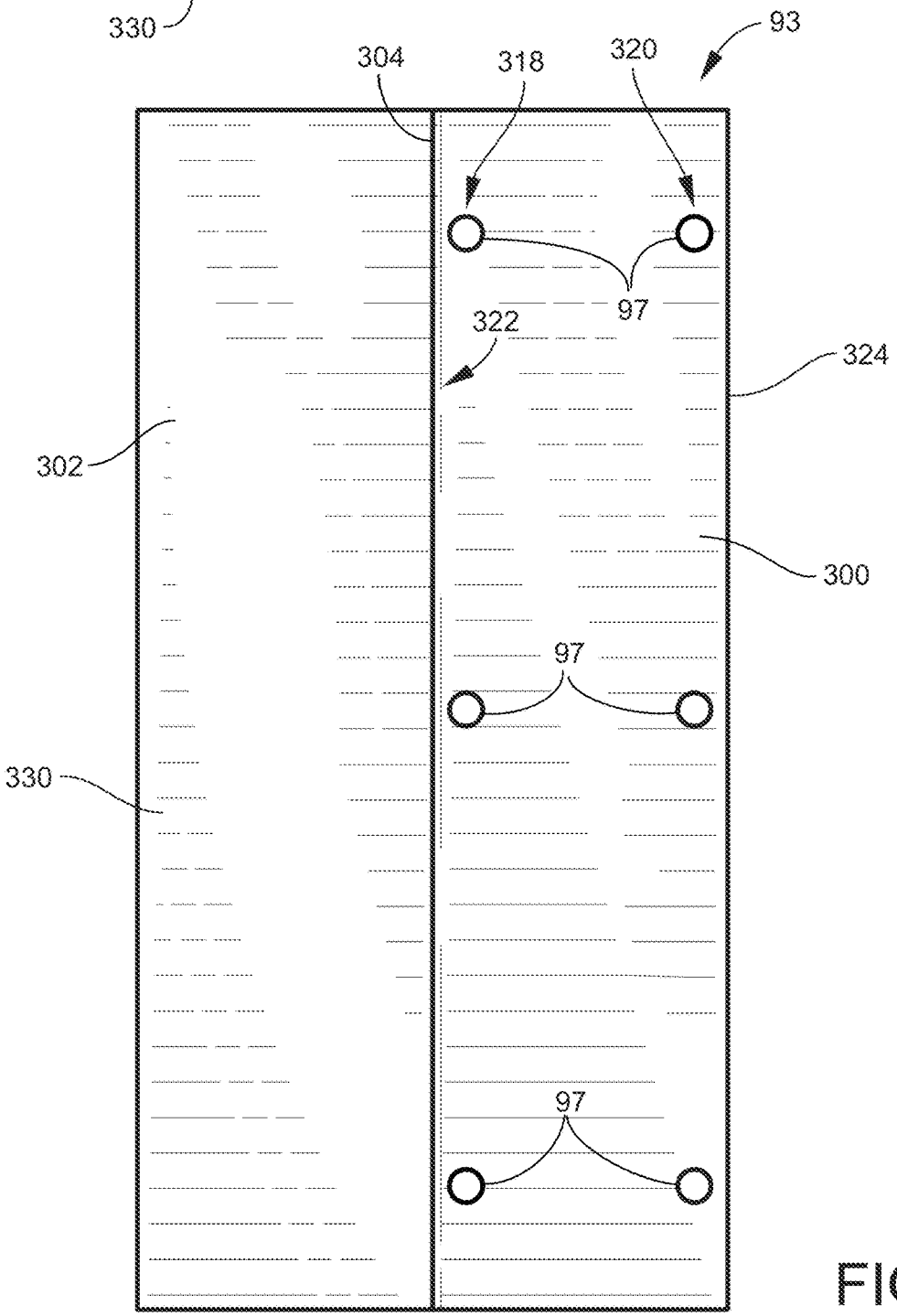
FIG. 16 shows a bottom view of the z-shaped bracket from FIG. 11.
Figure 17:
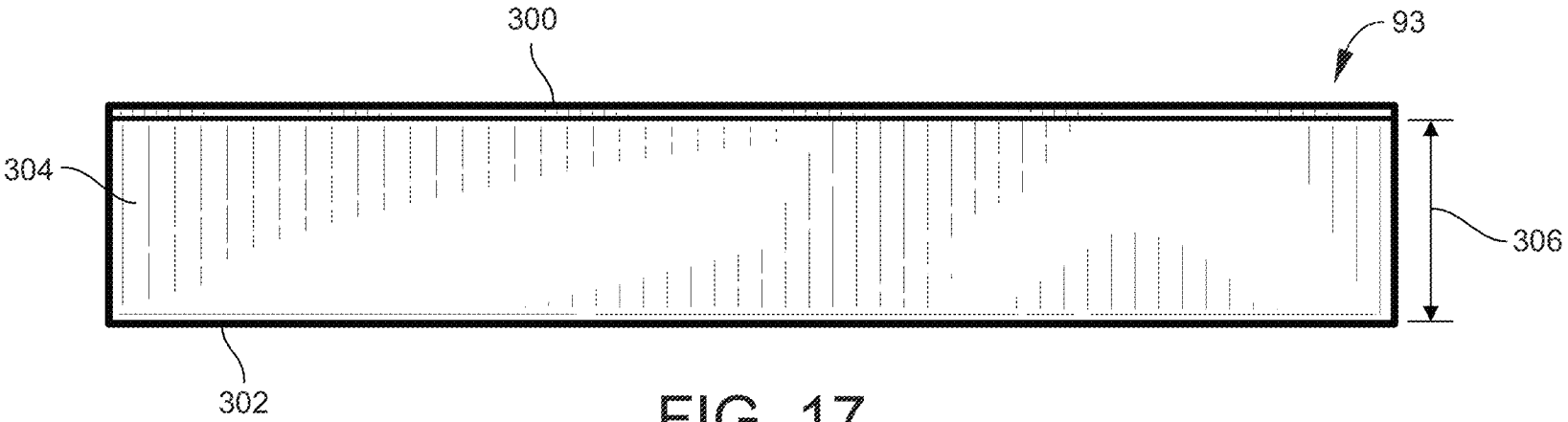
FIG. 17 shows a front view of the z-shaped bracket from FIG. 11.
Figure 18:
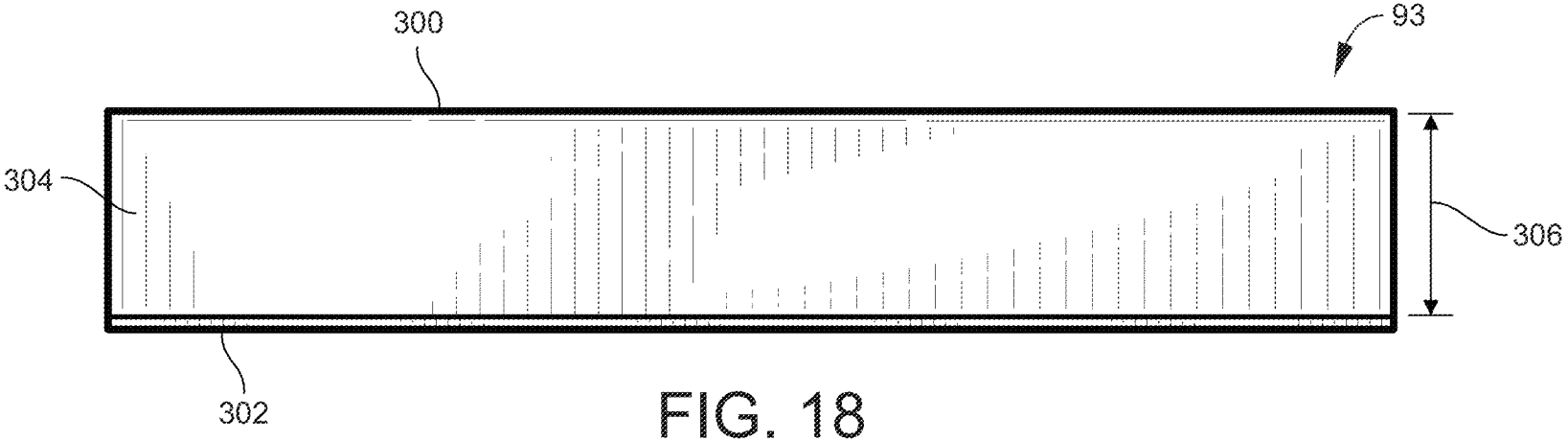
FIG. 18 shows a rear view of the z-shaped bracket from FIG. 11.
Figure 19:
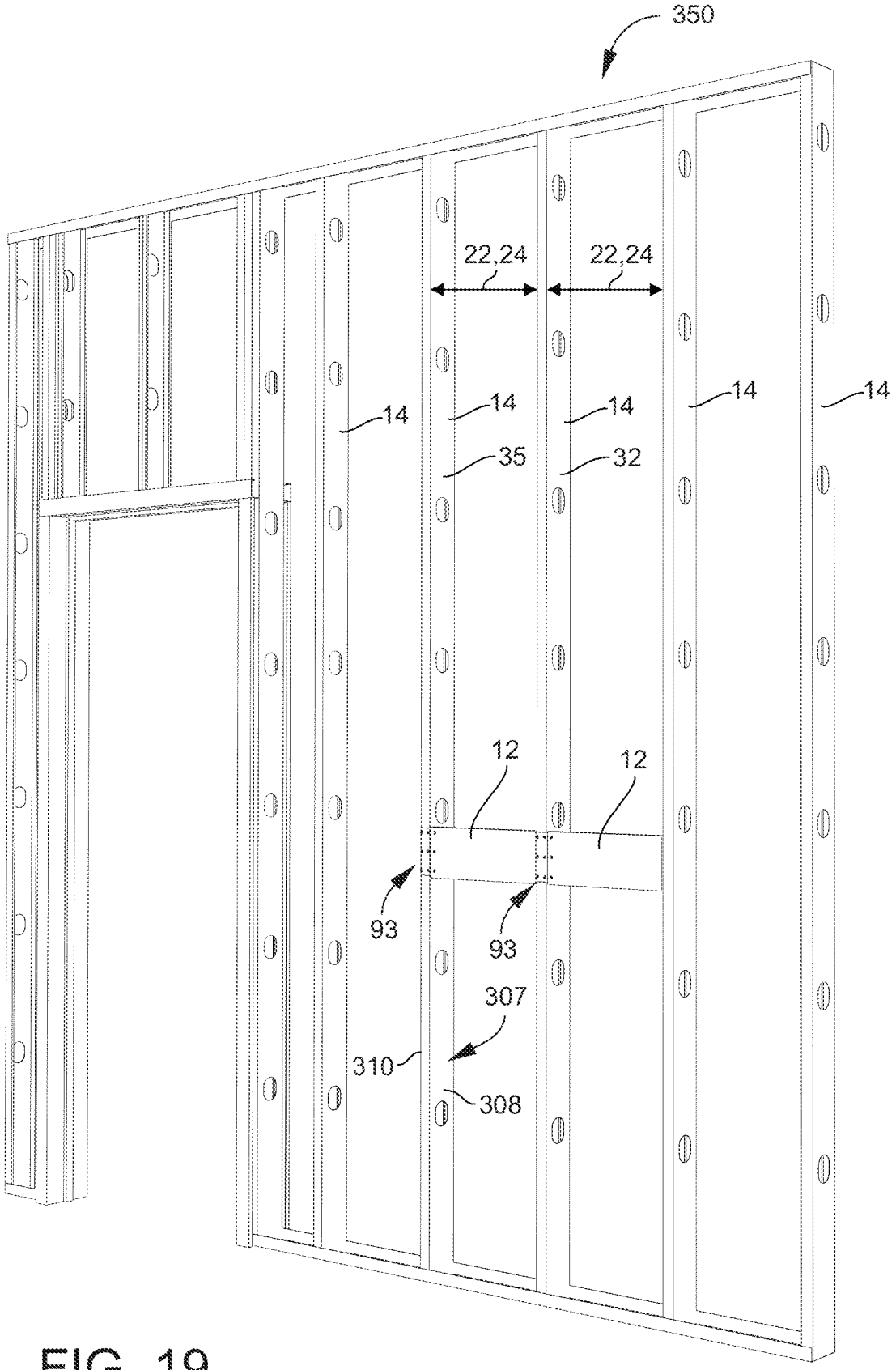
FIG. 19 shows a front environmental perspective view of the wood blocking or fire proofing connected between adjacent metal studs via the z-shaped bracket from FIG. 11.
Figure 20:
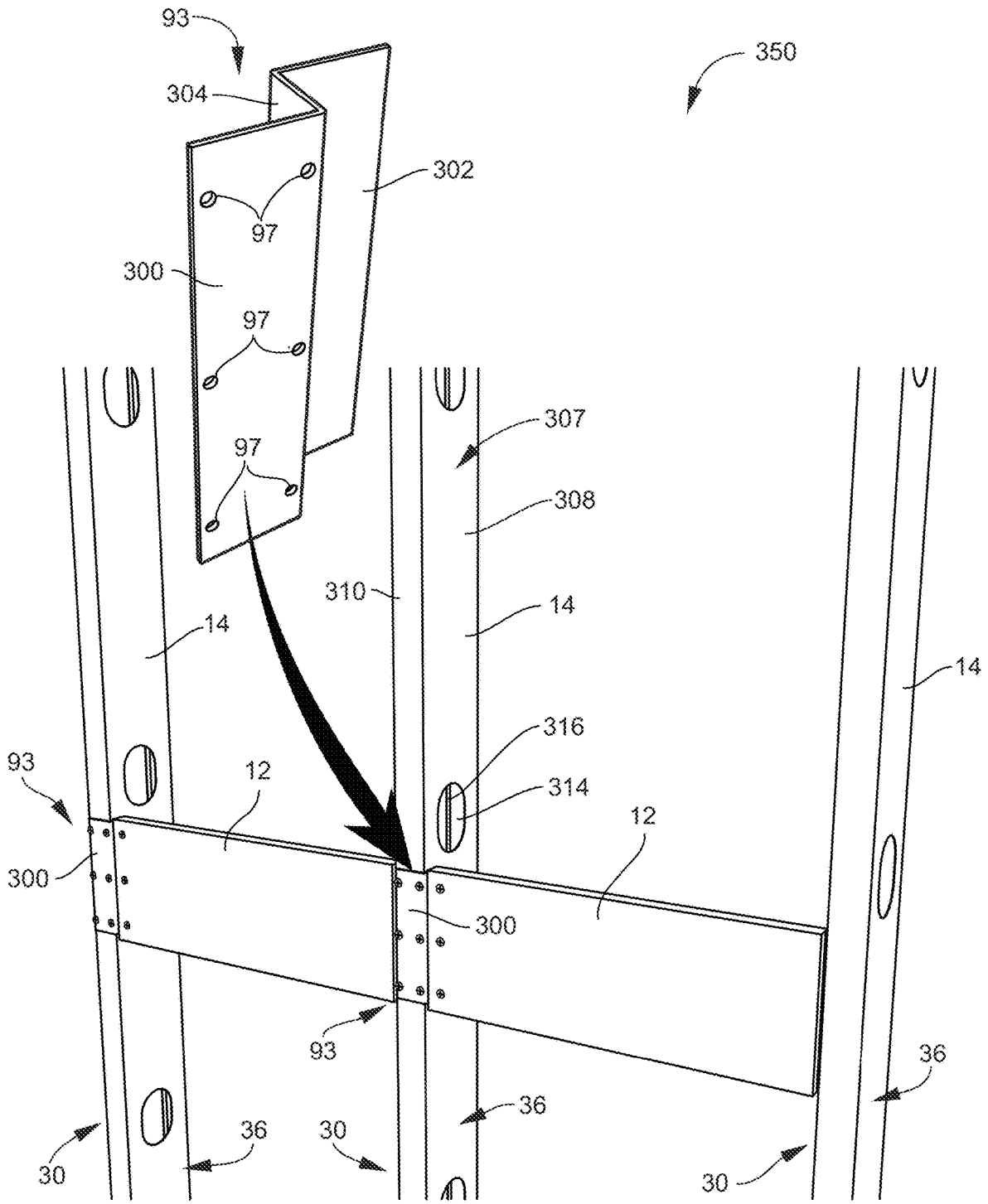
FIG. 20 shows a zoomed in front environmental perspective view of the wood blocking or fire proofing connected between adjacent metal studs via the z-shaped bracket from FIG. 11.
Figure 21:
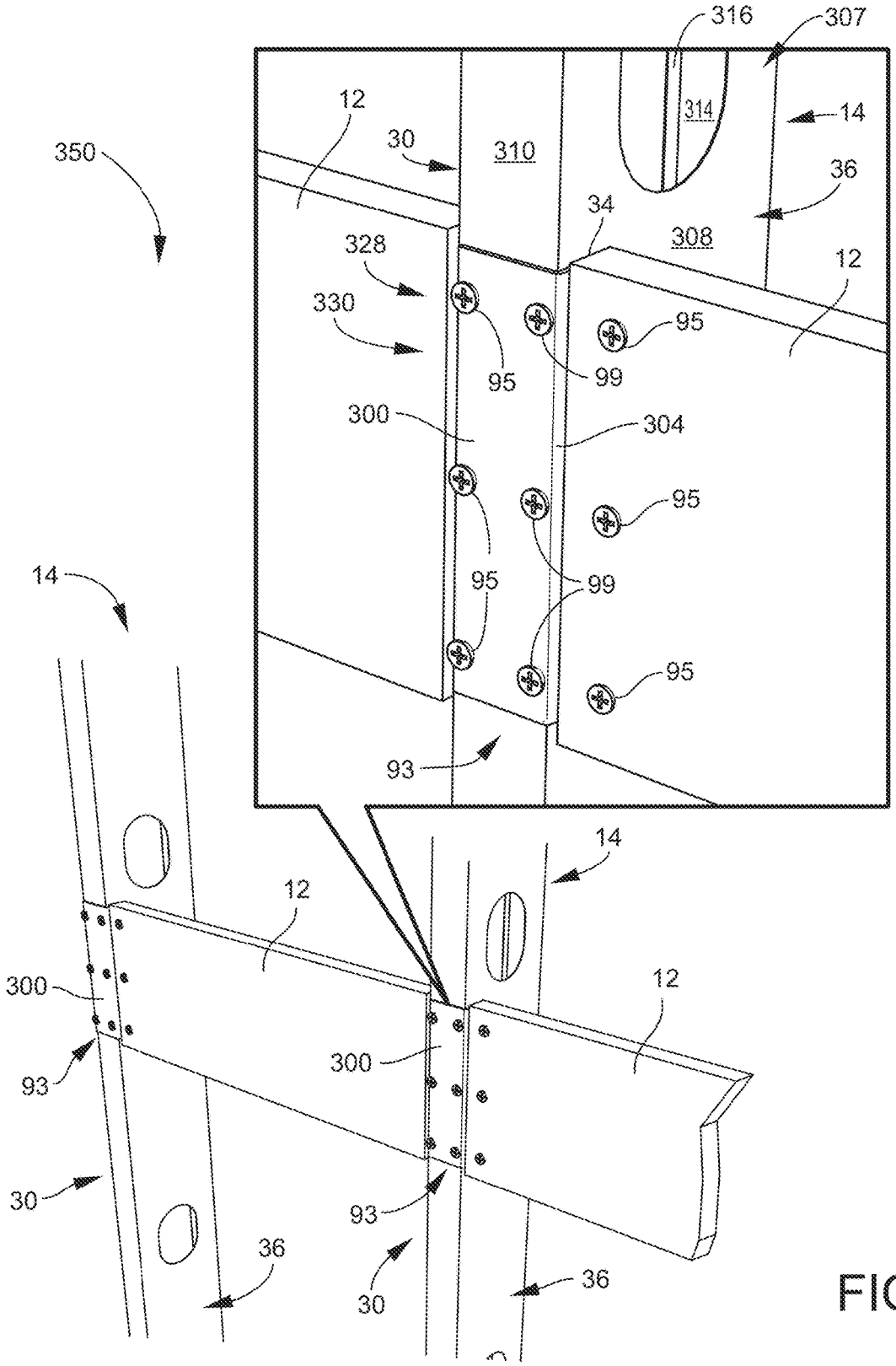
FIG. 21 shows another zoomed in front environmental perspective view of the wood blocking or fire proofing connected between adjacent metal studs via the z-shaped bracket from FIG. 11.

Offset distance 306 between first flange surface 300 and second flange surface 302 may be created via connecting web surface 304. Offset distance 306 may provide enough space to fit wood blocking 12 onto second flange surface 302 and be flush with first flange surface 300 or slightly recessed from first flange surface 300. As such, one feature of the disclosed z-shaped bracket 93 for wood blocking 12 may be that offset distance 306 created by connecting web surface 304 may be approximately thickness 332 of wood blocking 12. To prevent interference of square edge 336 of blocking 12 at radius bend 338 of z-shaped bracket 93 (as best shown in the zoomed in portion of FIG. 26), first flange surface 300 may be oriented at slightly acute angle 334 (as best shown in FIGS. 14 and 15) to connecting web surface 304, and second flange surface 302 may be oriented at the same slightly acute angle 334 (as best shown in FIGS. 14 and 15) to connecting web surface 304. Whereby, the combination of first flange surface 300, connecting web surface 304 and second flange surface 302 being formed at slightly acute angle 334 create the z-shape configuration of z-shaped bracket 93. This z-shaped configuration may be configured to prevent interference of square edge 336 of blocking 12 at radius bend 338 of z-shaped bracket 93 when affixing blocking 12 on second flange surface 302. Slightly acute angle 334 may be any desired angle that is slightly less than 90 degrees. In select embodiments, slightly acute angle 334 may be 89 degrees or approximately 89 degrees.

Z-shaped bracket 93 can be made from various desired materials configured for securing wood blocking (like wood backing or fireproofing) between metal studs 14. In select possibly preferred embodiments, z-shaped bracket 93 can be made from light gauge metal 330. In this light gauge metal 330 embodiment, z-shaped bracket 93 may be formed from an integral piece of light gauge metal 330 that is bent to create first flange surface 300, connecting web surface 304 and second flange surface 302 with slightly acute angle 334 between each bend. In addition, plurality of holes 97 may be punched into the light gauge metal 330 in first flange surface 300 of z-shaped bracket 93. In select embodiments, light gauge metal 330 may be equal to or greater than 10 gauge metal. In select possibly preferred embodiments, light gauge metal 330 may be between 12 gauge metal and 24 gauge metal. In other possibly most preferred embodiments, light gauge metal 330 material of z-shaped bracket 93 may be 20 gauge metal (as shown in FIG. 11-18) or 16 gauge metal (as shown in FIG. 27).

Referring now specifically to FIGS. 19-26 and 28-30, wood blocking system 350 is shown that utilizes z-shaped bracket 93 for attaching wood blocking 12 between metal studs 14. As such, wood blocking system 350 may generally include wood blocking 12 placed between metal studs 14 via the disclosed z-shaped bracket 93 in any of the various embodiments shown and/or described herein. As a result, wood blocking system 350 may include panel of a blocking material 12 having standard width 22. Standard width 22 of the panel of blocking material 12 may be sized to nominal stud width 24 configured to fit between metal studs 14. Metal studs 14 may include first metal stud 32 and adjacent metal stud 35. Each of first metal stud 32 and adjacent metal stud 35 may be c-channel metal studs 307 including hard side 36 including flat web 308. Z-shaped bracket 93 of wood blocking system 350 may include bracket 93 having first flange surface 300, second flange surface 302 and connecting web surface 304. First flange surface 300 may have plurality of holes 97 therethrough. Connecting web surface 304 connects first flange surface 300 and second flange surface 302 at offset distance 306. Second flange surface 302 may be parallel with first flange surface 300 and may be offset the offset distance 306 from first flange surface 300. Wherein, z-shaped bracket 93 may be configured to secure panel of blocking material 12 between metal studs 14.

Figure 22:
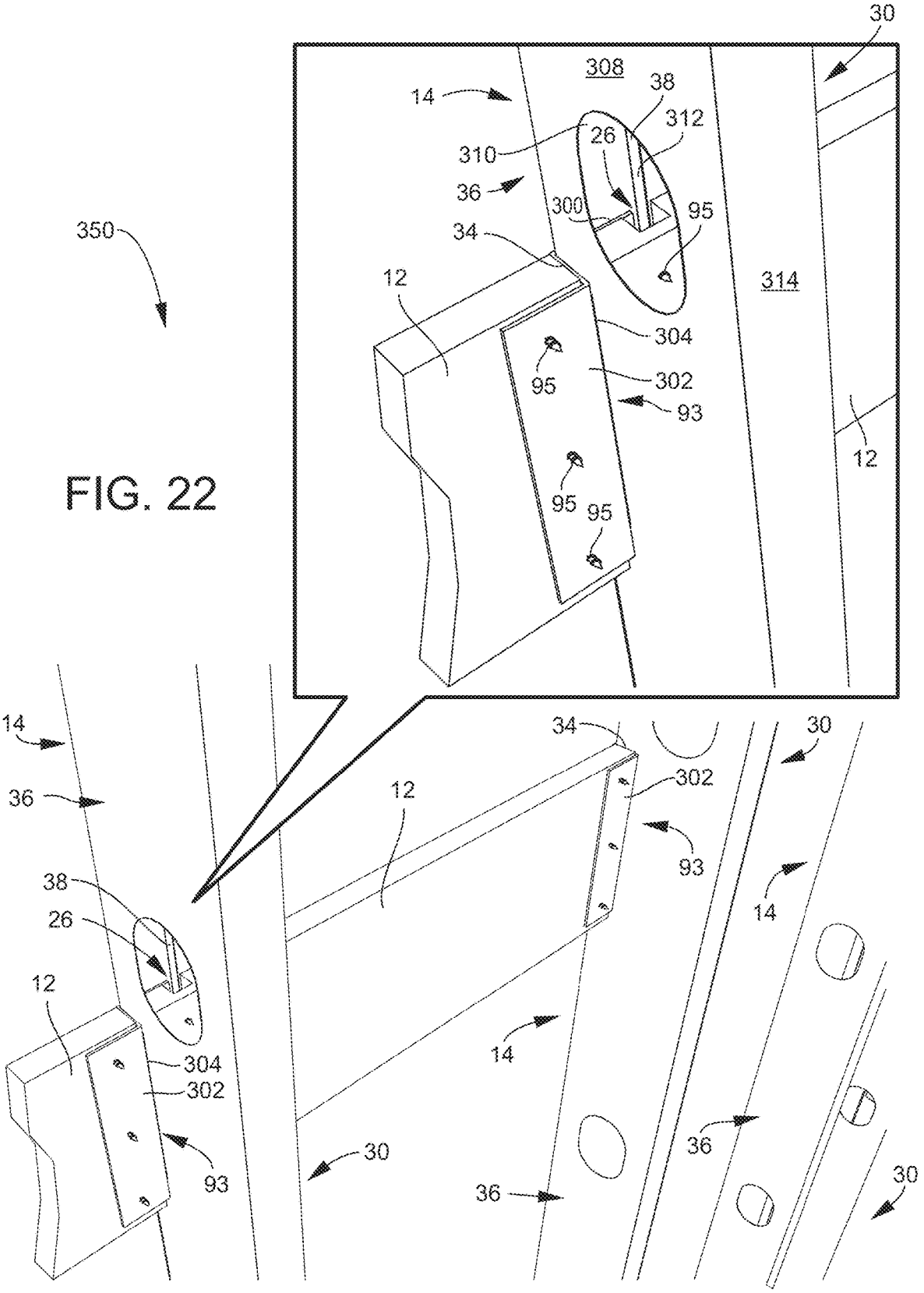
FIG. 22 shows a zoomed in rear environmental perspective view of the wood blocking or fire proofing connected between adjacent metal studs via the z-shaped bracket from FIG. 11.
Figure 23:
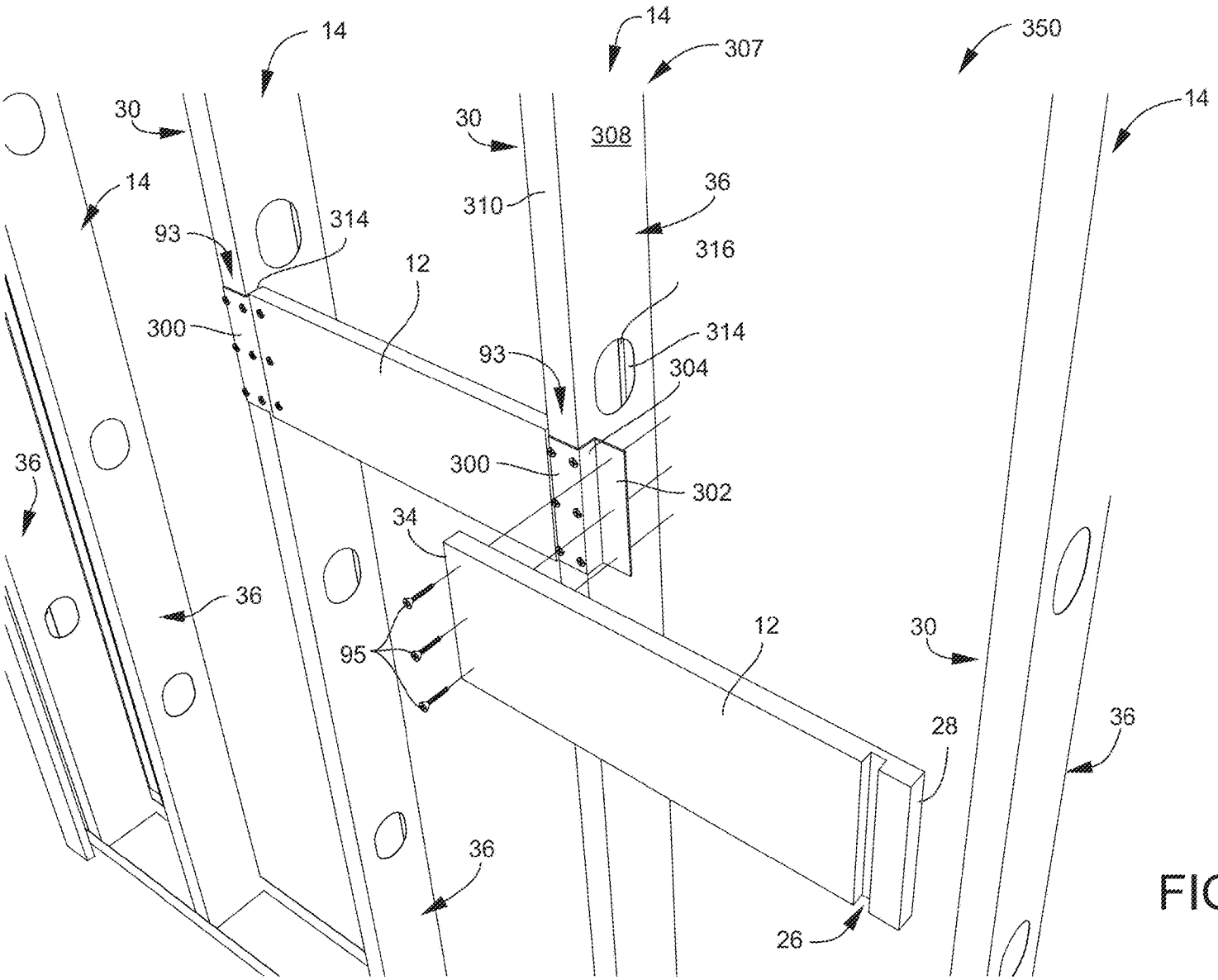
FIG. 23 shows a partially disassembled front environmental perspective view of the wood blocking or fire proofing connected between adjacent metal studs via the z-shaped bracket from FIG. 11.
Figure 24:
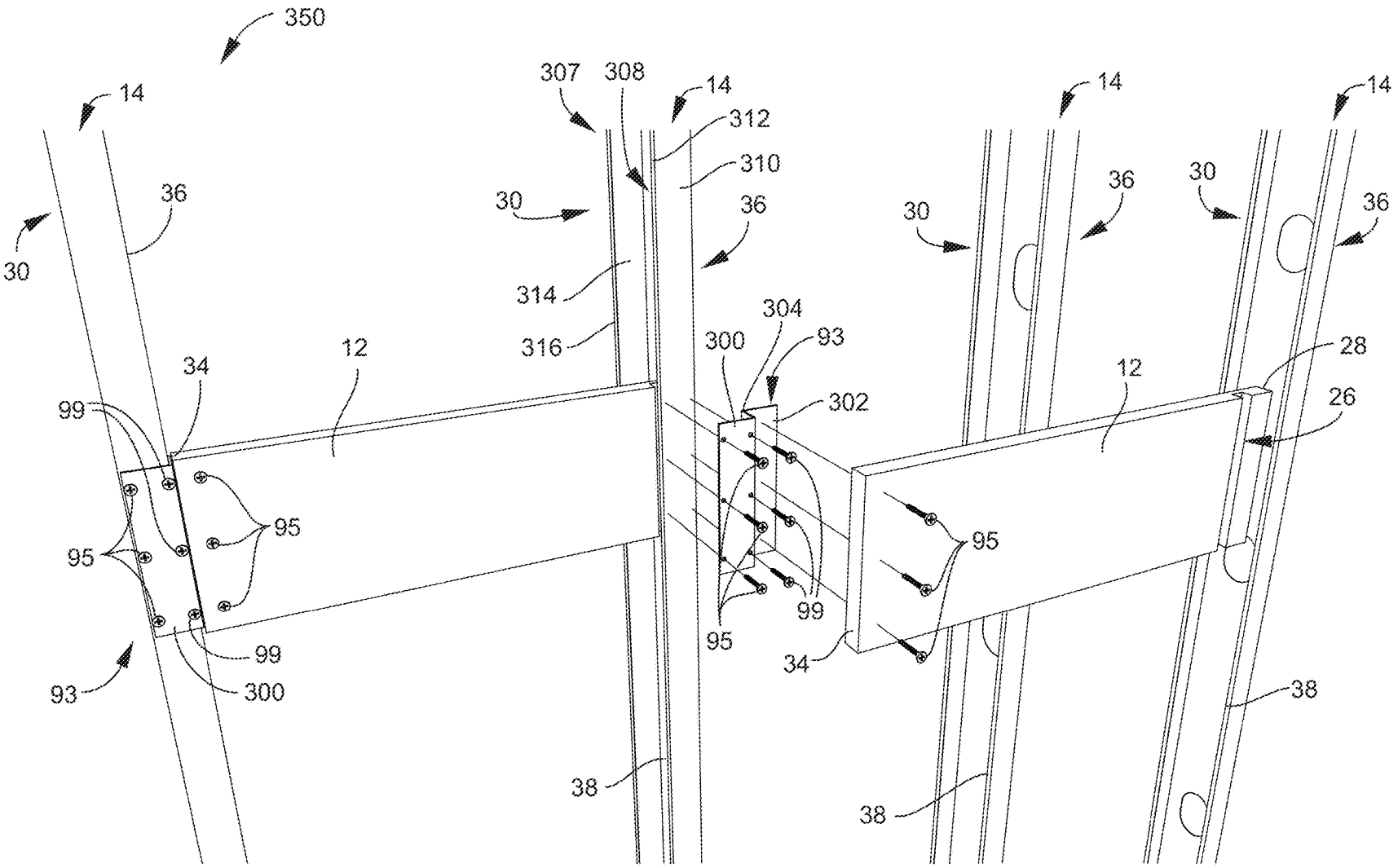
FIG. 24 shows another partially disassembled front environmental perspective view of the wood blocking or fire proofing connected between adjacent metal studs via the z-shaped bracket from FIG. 11.
Figure 26:
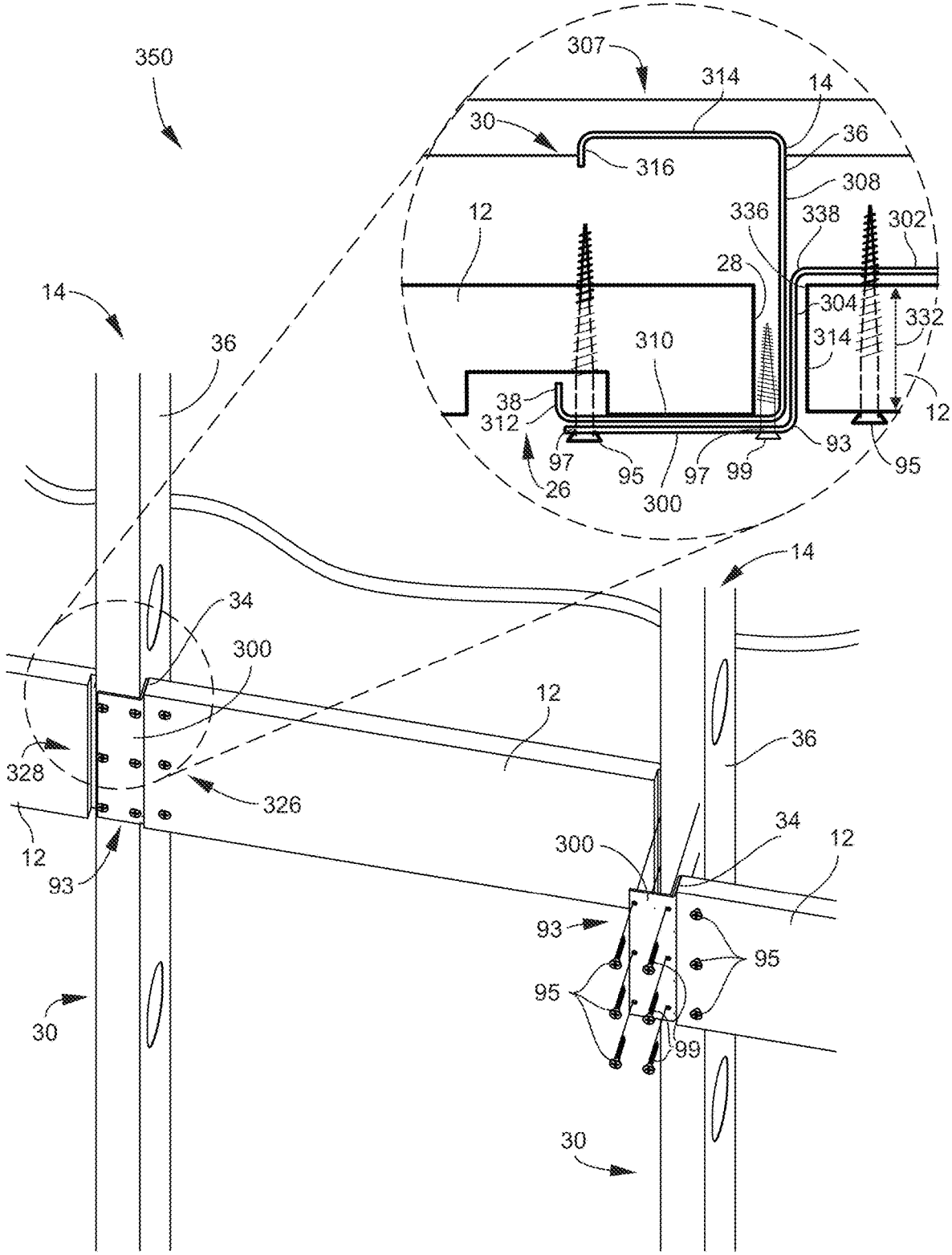
FIG. 26 shows another partially disassembled front environmental perspective view of the wood blocking or fire proofing connected between adjacent metal studs via the z-shaped bracket from FIG. 11 with a zoomed-in top view of the z-bracket from FIG. 11 connecting one side of wood blocking or fire proofing to the soft side of a metal stud and the other side of another wood blocking or fire proofing to the hard side of the same metal stud.

As shown in FIG. 23, plurality of holes 97 may be configured for pre-installing bracket 93 on metal stud 14 in wood blocking system 350. First flange surface 300 may be positioned on outer flange 310 of metal stud 14. Connecting web surface 304 may be positioned against hard side 36 of metal stud 14. And second flange surface 302 may extend approximately perpendicular (may not be exactly perpendicular because of slightly acute angle 334) from hard side 36 of metal stud 14. Second flange surface 302 may be configured for attachment to wood blocking 12, as best shown in FIGS. 22, 24 and 26.

Figure 25:
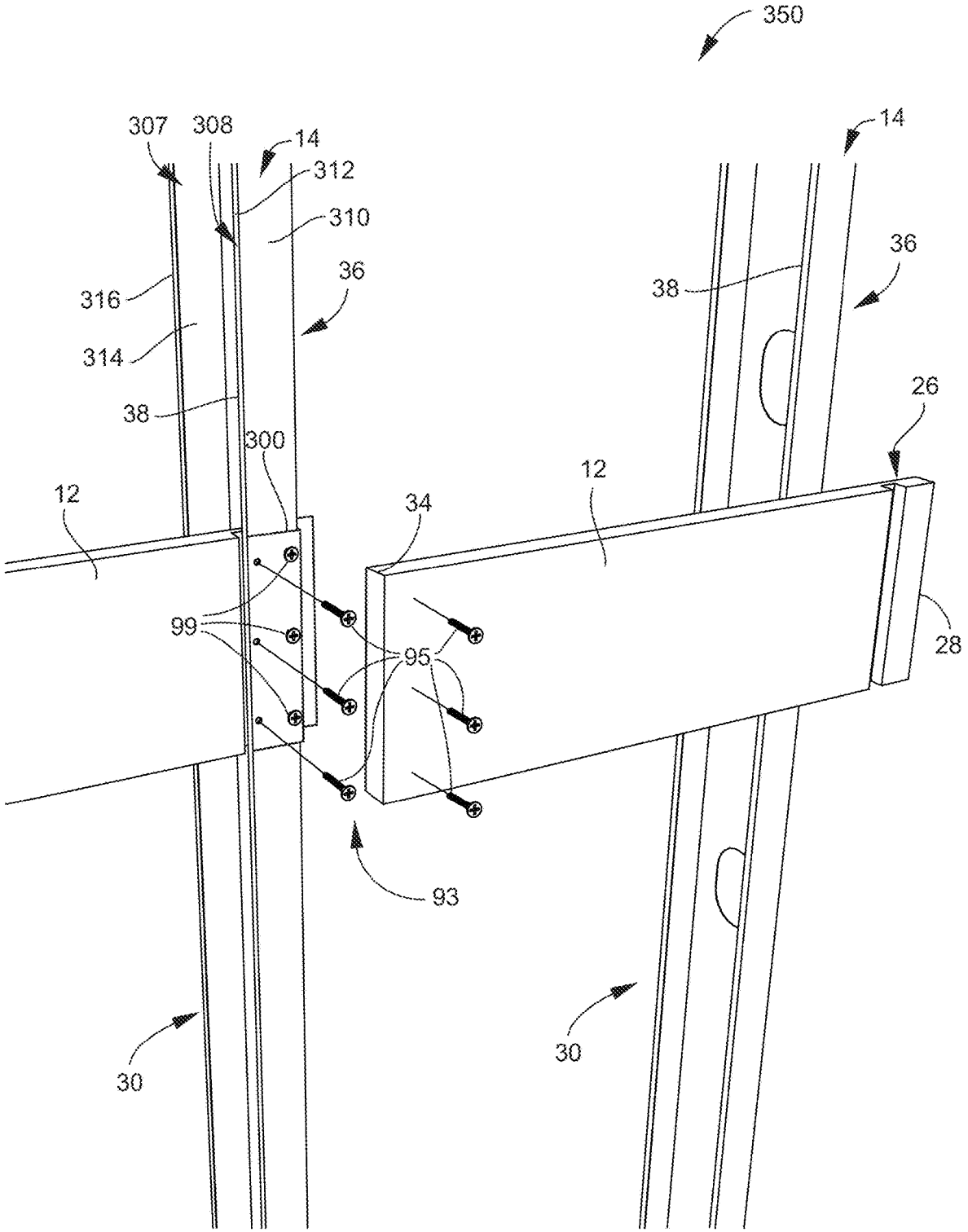
FIG. 25 shows another partially disassembled front environmental perspective view of the wood blocking or fire proofing connected between adjacent metal studs via the z-shaped bracket from FIG. 11.

Referring specifically to FIG. 25 (also shown in FIGS. 21, 24, 26, and 29, z-shaped bracket 93 may be installed onto metal stud 14 via fasteners 99 being inserted through first vertical row 318 of holes 97. Fastener 99 may be a shorter framing screw that can be inserted through first vertical row 318 of holes 97 and be positioned against hard side 36 of metal stud 14. This position of framing screw fastener 99 may provide valuable benefits to the wood blocking system. First, framing screw fastener 99 may pre-install or position z-shaped bracket 93 on metal stud 14 at the desired position. In addition, framing screw fastener 99 may also provide for an alignment guide or interference fit for where to position wood blocking 12 inside metal stud 14 or under lip 38 of soft side 30 of metal stud 14, where groove 26 is properly positioned and aligned with lip 38. Furthermore, framing screw fastener 99 may also push metal stud 14 back to 16 inch or 24 inch stud centers if framing is slightly off. This may be important because drywall is hung vertically on metal studs 14 and panels are 48 inches wide. Thus, if stud centers are not maintained then drywall has nothing to hang to at panel edges.

Figure 31:
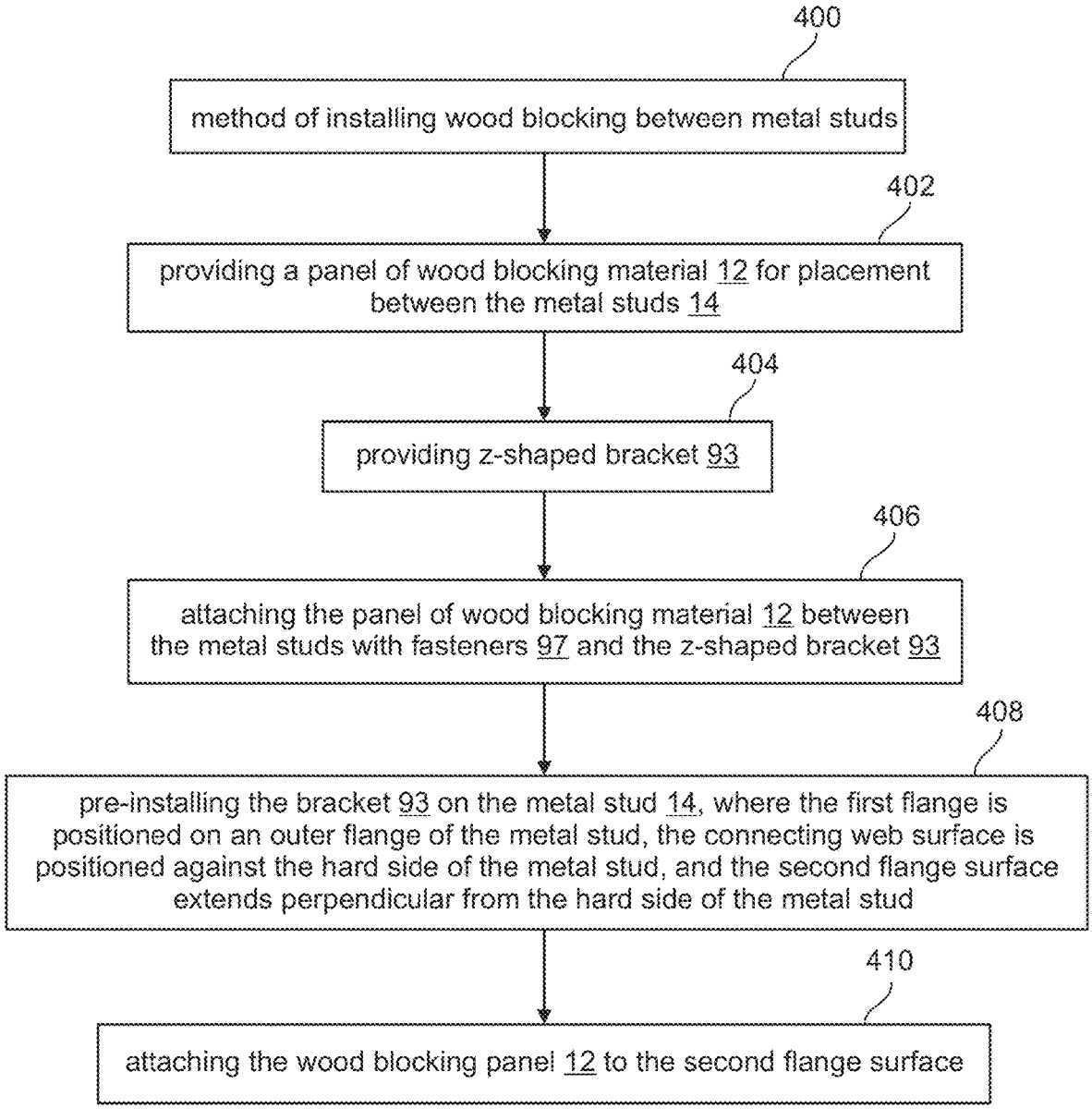
FIG. 31 shows a flow chart of a method of installing wood blocking between metal studs according to select embodiments of the instant disclosure.

Referring now to FIGS. 31-34, in another aspect, the instant disclosure embraces method 400 of installing wood blocking 12 between metal studs 14. In general, the disclosed method 400 may include installing wood blocking 12 between metal studs 14 via the disclosed z-shaped bracket 93 in any of the various embodiments shown and/or described herein of z-shaped bracket 93. As such, as shown in FIG. 31, method 400 of installing wood blocking 12 may include the steps of: step 402 of providing a panel of wood blocking material 12 for placement between the metal studs 14, the panel of wood blocking material 12 having standard width 22. where standard width 22 is sized to nominal stud width 24 configured to fit between metal studs 14; step 404 of providing z-shaped bracket 93 in any of the various embodiments shown and/or described herein; and step 406 of attaching the panel of wood blocking material 12 between metal studs 14 with fasteners 95 and z-shaped bracket 93. In select embodiments of method 400 of installing wood blocking 12 between metal studs 14, the plurality of holes 97 are punched through the first flange surface 300, wherein the step of 406 of attaching the panel of wood blocking material 12 between the metal studs 14 with fasteners 95 and z-shaped bracket 93 may include the steps of: step 408 of pre-installing bracket 93 on metal stud 14, where first flange surface 300 is positioned on outer flange 310 of metal stud 14, connecting web surface 304 is positioned against hard side 36 of metal stud 14, and second flange surface 302 extends approximately perpendicular from hard side 36 of metal stud 14; and step 410 of attaching wood blocking panel 12 to second flange surface 302 (like via fasteners 95).

Figure 28:
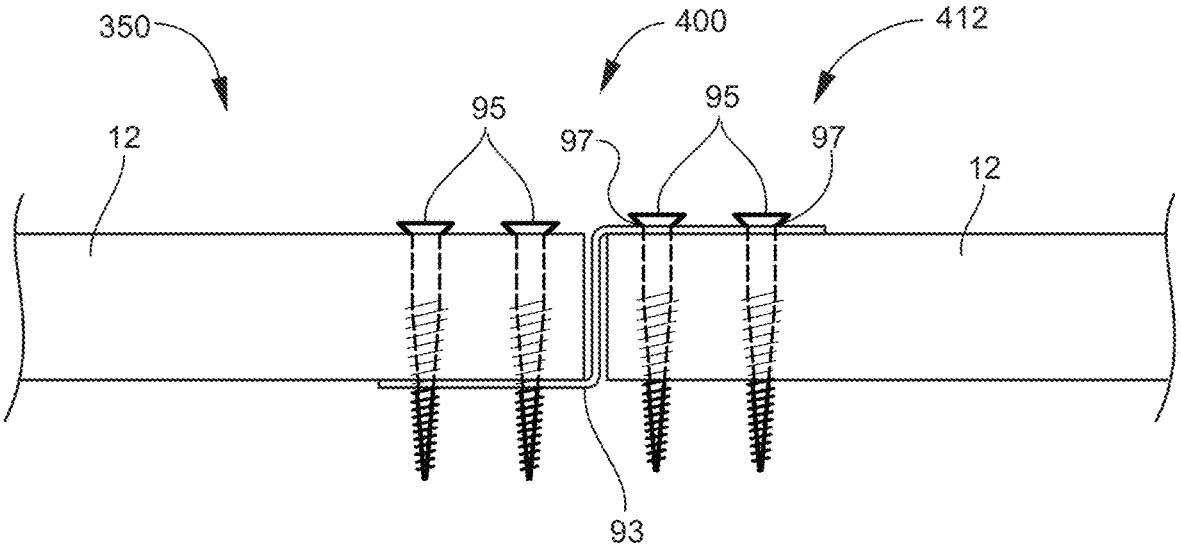
FIG. 28 shows a top view of a z-shaped bracket according to select embodiments of the instant disclosure connecting two wood blocking panels end to end.
Figure 32:
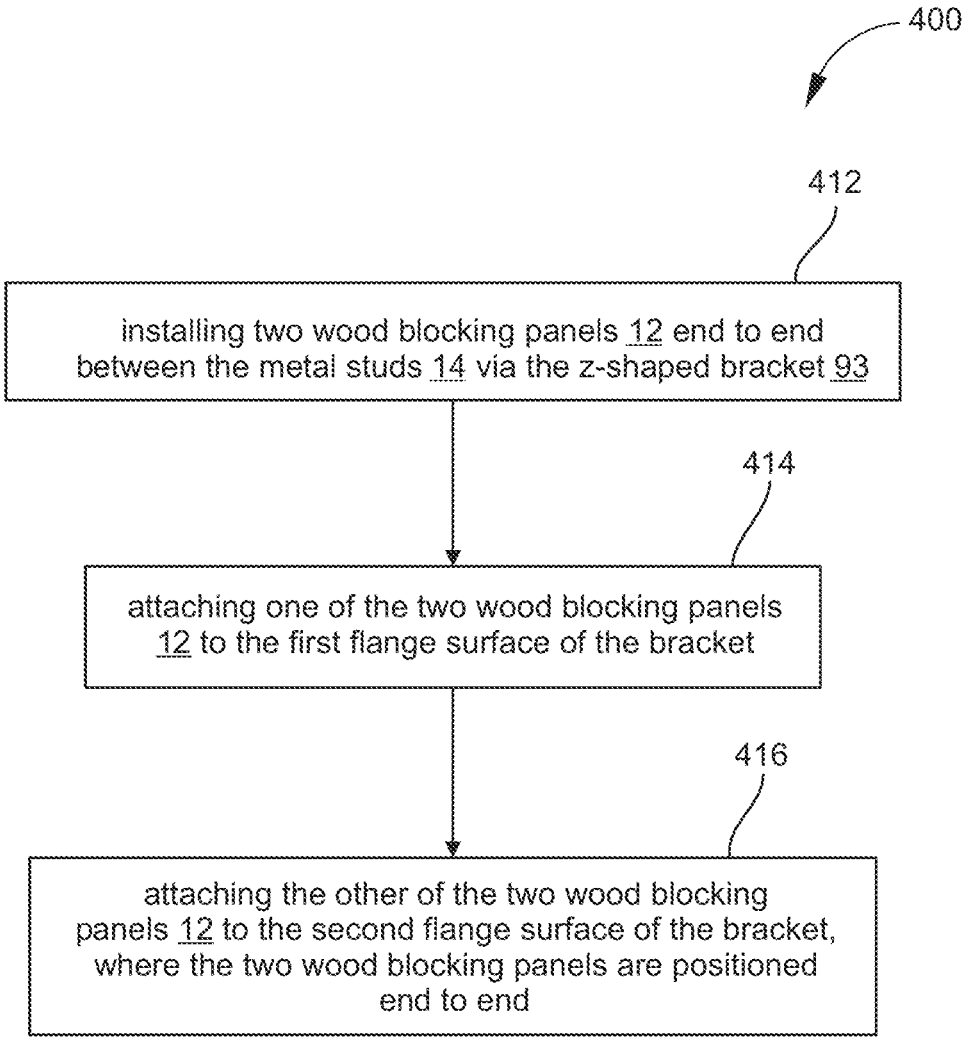
FIG. 32 shows a flow chart of a step of installing two wood blocking panels end to end between the metal studs via the z-shaped brackets according to select embodiments of the method of installing wood blocking between metal studs of FIG. 31.

Referring now specifically to FIG. 32, in other select embodiments of method 400 of installing wood blocking 12 between metal studs 14, method 400 may further include step 412 of installing two wood blocking panels 12 end to end between metal studs 14 via z-shaped bracket 93, as shown in FIG. 28. Step 412 of installing two wood blocking panels 12 end to end between metal studs 14 via z-shaped bracket 93 may include the steps of: step 414 of attaching one of the two wood blocking panels 12 to first flange surface 300 of bracket 93 (like via fasteners 95 and 99); and step 416 of attaching the other of the two wood blocking panels 12 to second flange surface 302 of bracket 93 (like via fasteners 95 and 99). As a result, the two wood blocking panels 12 are positioned end to end, as shown in FIG. 28.

Figure 29:
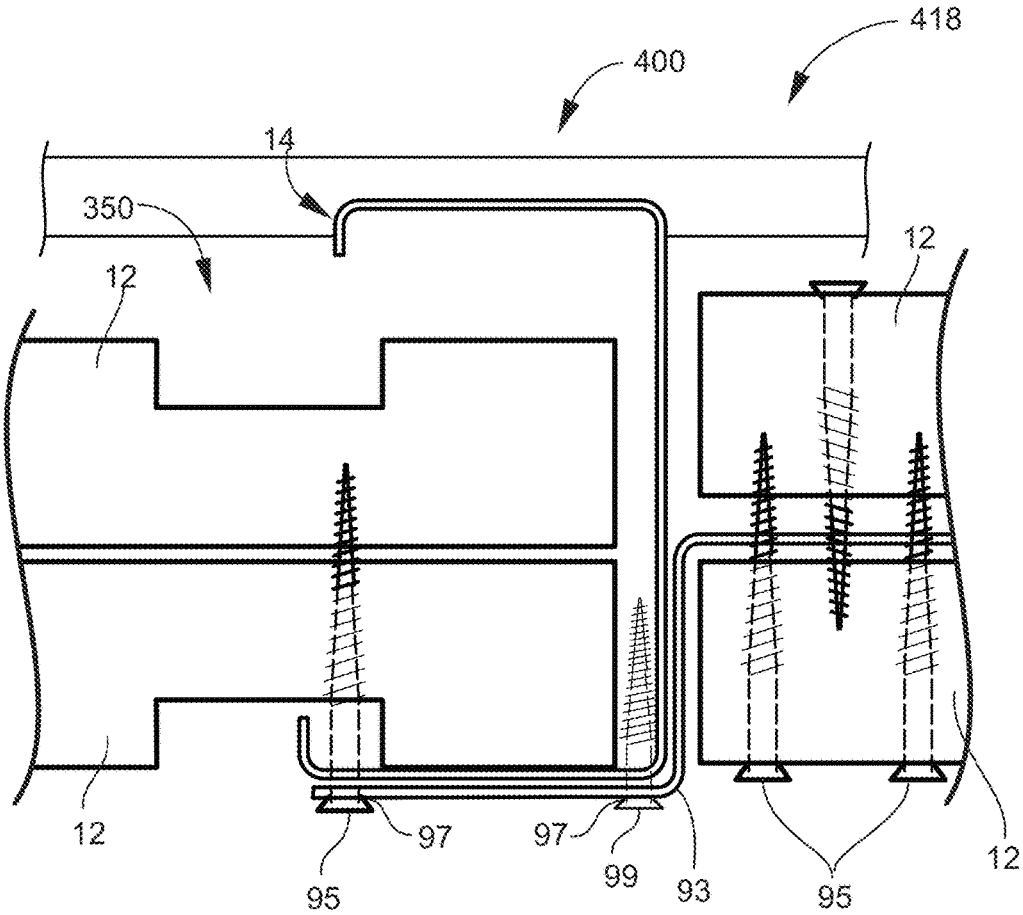
FIG. 29 shows a top view of two z-shaped brackets according to select embodiments of the instant disclosure connecting two wood blocking panels on top of one another to both sides of a metal stud.
Figure 33:
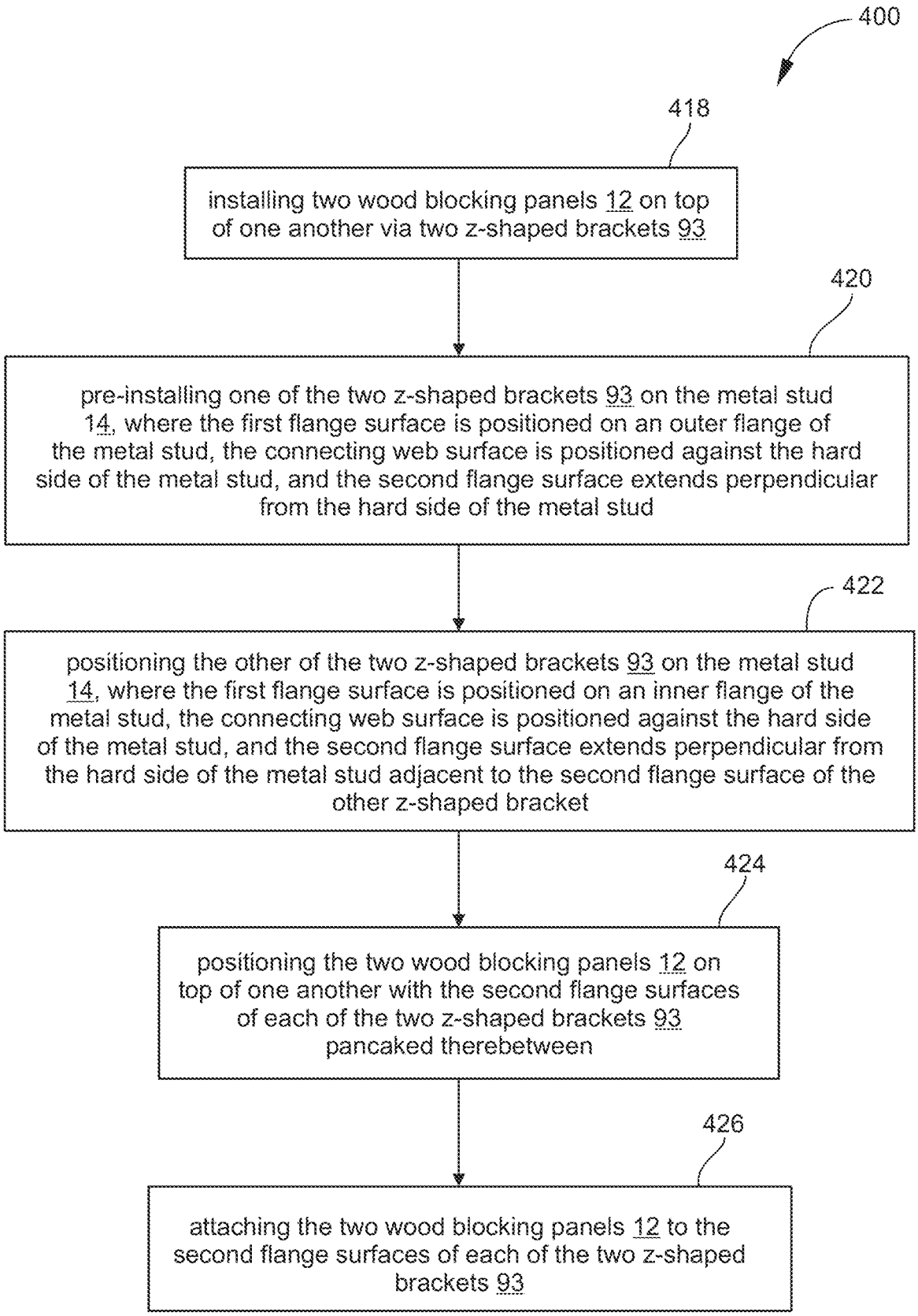
FIG. 33 shows a flow chart of a step of installing two wood blocking panels on top of one another via two z-shaped brackets according to select embodiments of the method of installing wood blocking between metal studs of FIG. 31.

Referring now specifically to FIG. 33, in other select embodiments of method 400 of installing wood blocking 12 between metal studs 14, method 400 may further include step 418 of installing two wood blocking panels 12 on top of one another via two z-shaped brackets 93, as shown in FIG. 29. Step 418 of installing two wood blocking panels 12 on top of one another via two z-shaped brackets 93 may include the steps of: step 420 of pre-installing one of the two z-shaped brackets 93 on metal stud 14, where first flange surface 300 is positioned on outer flange 310 of metal stud 14, connecting web surface 304 is positioned against hard side 36 of metal stud 14, and second flange surface 302 extends approximately perpendicular from hard side 36 of metal stud 14; step 422 of positioning the other of the two z-shaped brackets 93 on metal stud 14, where first flange surface 300 is positioned on inner flange 314 of metal stud 14, connecting web surface 304 is positioned against hard side 36 of metal stud 14, and second flange surface 302 extends approximately perpendicular from hard side 36 of metal stud 14 adjacent to second flange surface 302 of the other z-shaped bracket 93; step 424 of positioning the two wood blocking panels 12 on top of one another with second flange surfaces 302 of each of the two z-shaped brackets 93 pancaked therebetween; and step 426 of attaching the two wood blocking panels 12 to the second flange surfaces 302 of each of the two z-shaped brackets 93 (like via fasteners 95 and 99). As a result, the two wood blocking panels 12 are positioned on top of one another, as shown in FIG. 29.

Figure 30:
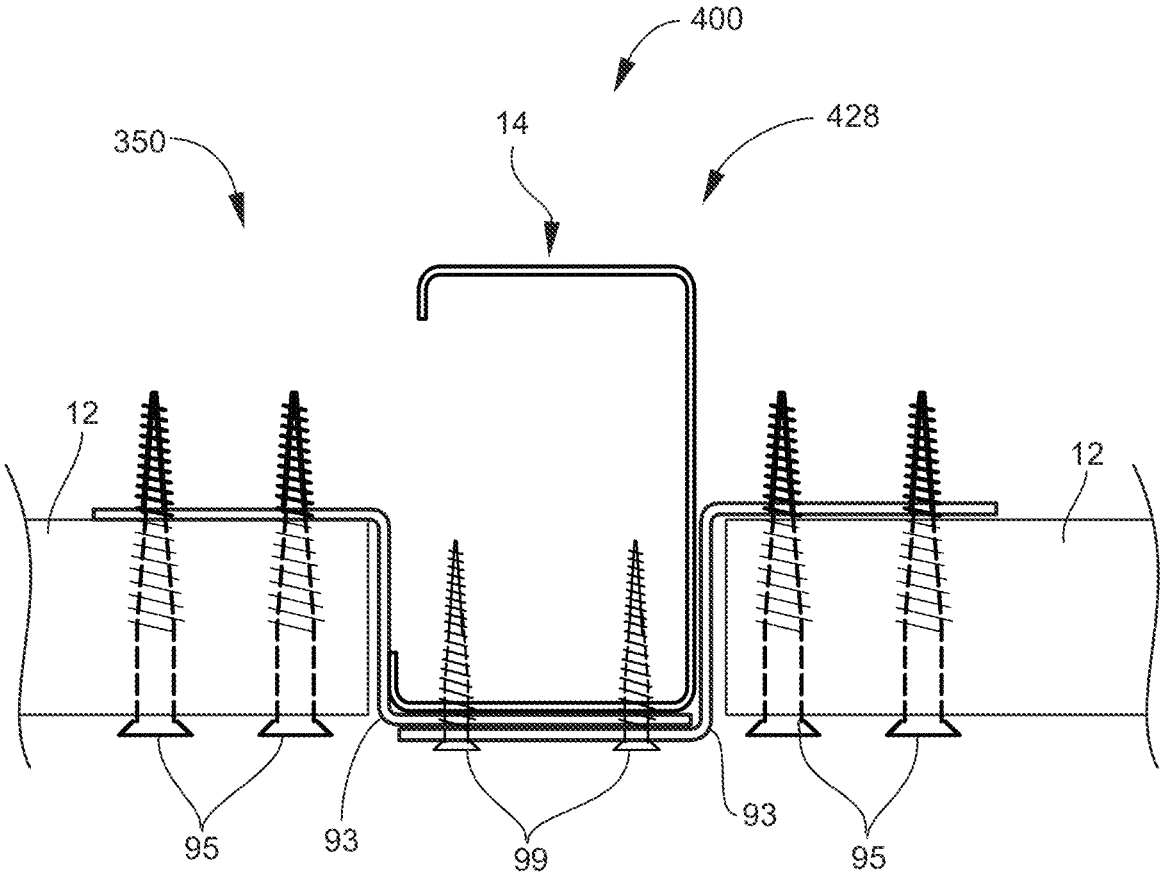
FIG. 30 shows a top view of two z-shaped brackets according to select embodiments of the instant disclosure connecting two wood blocking panels, one on each side of the metal stud.
Figure 34:
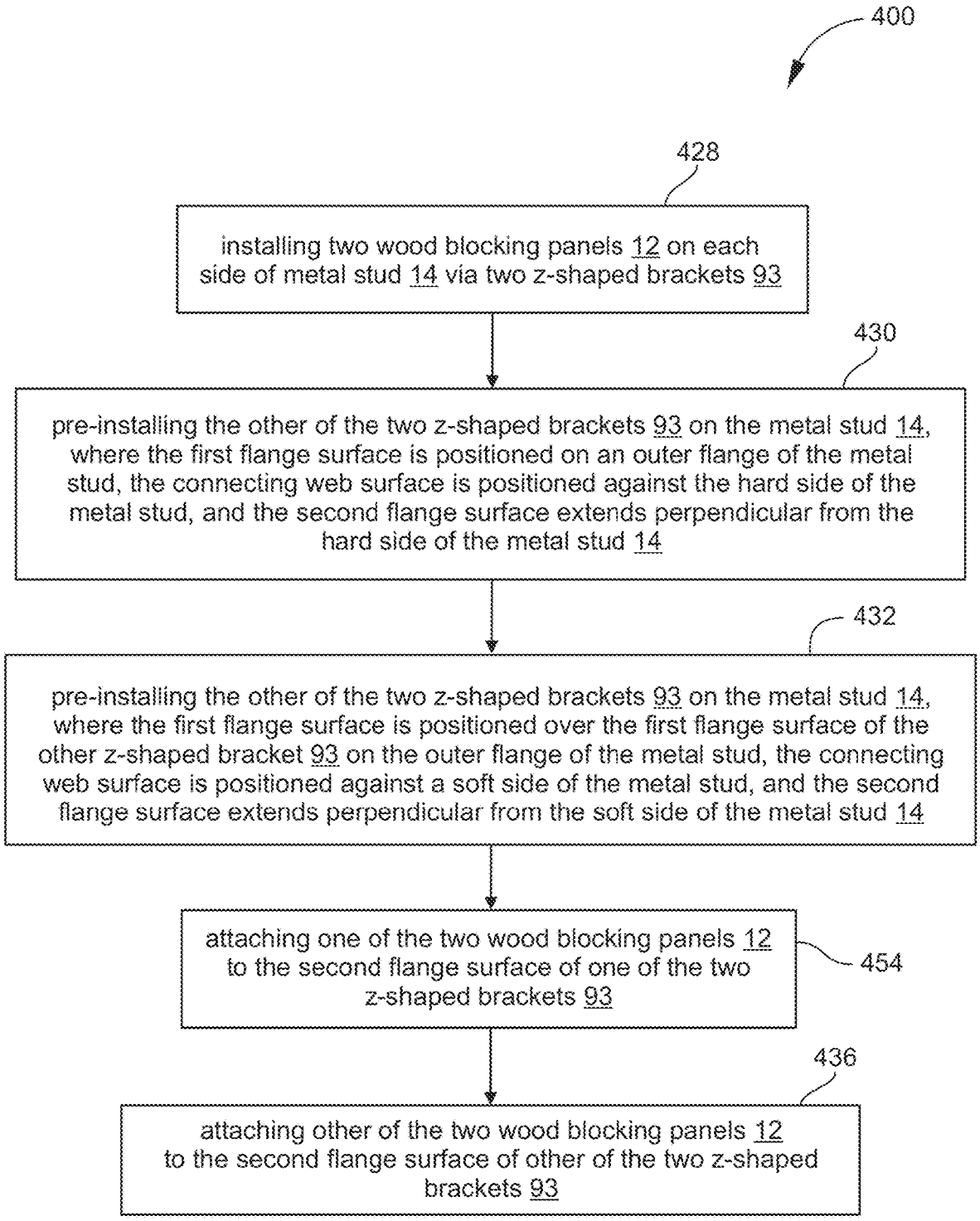
FIG. 34 shows a flow chart of a step of installing two wood blocking panels on each side of a metal stud via two z-shaped brackets according to select embodiments of the method of installing wood blocking between metal studs of FIG. 31.

Referring now specifically to FIG. 34, in other select embodiments of method 400 of installing wood blocking 12 between metal studs 14, method 400 may further include step 428 of installing two wood blocking panels 12 on each side of metal stud 14 via two z-shaped brackets 93, as shown in FIG. 30. Step 428 of installing two wood blocking panels 12 on each side of metal stud 14 via two z-shaped brackets 93 may include the steps of: step 430 of pre-installing one of the two z-shaped brackets 93 on metal stud 14, where first flange surface 300 is positioned on outer flange 310 of metal stud 14, connecting web surface 304 is positioned against hard side 36 of metal stud 14, and second flange surface 302 extends approximately perpendicular from hard side 36 of metal stud 14; step 432 of pre-installing the other of the two-z-shaped brackets 93 on metal stud 14, where first flange surface 300 is positioned over the first flange surface 300 of the other z-shaped bracket 93 on outer flange 310 of metal stud 14, connecting web surface 304 is positioned against soft side 30 of metal stud 14, and second flange surface 302 extends approximately perpendicular from soft side 30 of metal stud 14; step 434 of attaching one of the two wood blocking panels 12 to the second flange surface 302 of one of the two z-shaped brackets 93 (like via fasteners 95 and 99); and step 436 of attaching the other of the two wood blocking panels 12 to second flange surface 302 of the other of the two z-shaped brackets 93 (like via fasteners 95 and 99). As a result, the two wood blocking panels 12 are positioned on each side of the metal stud 14, as shown in FIG. 31.

Figure 35A:
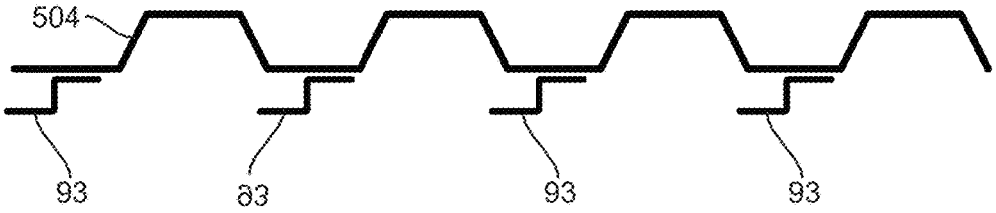
FIGS. 35A, 35B and 35C show diagrams of the disclosed z-shaped bracket used to attach metal studs to a composite deck that is treated with fire proofing and/or acoustic spray according to select embodiments of the instant disclosure, where
Figure 35B:
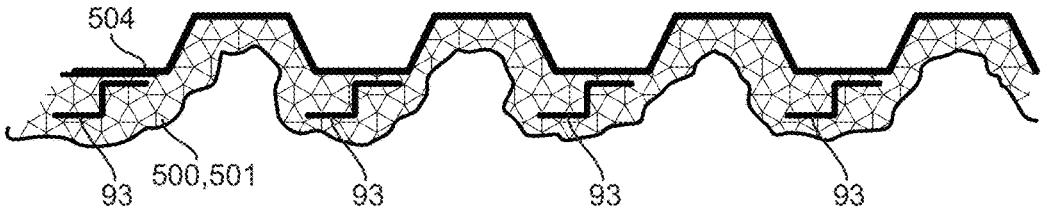
Figure 35C:
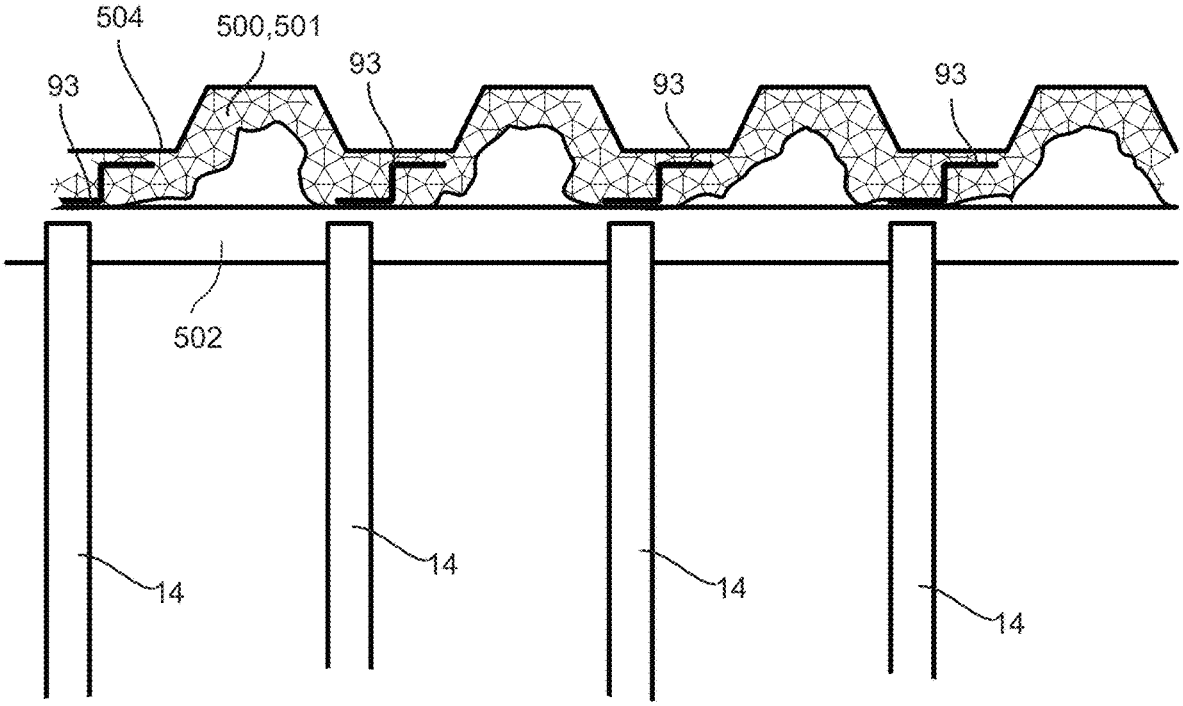

Referring now specifically to FIGS. 35A, 35B and 35C, diagrams are shown of z-shaped bracket 93 used to attach metal studs 14 to composite deck 504 that is treated with fire proofing 500 and/or acoustic spray 501. Fire proofing 500 may be full ¾ inch cementitious fire proofing material according to select embodiments of the instant disclosure. As shown in FIG. 35A, z-shaped brackets 93 may be first be connected to composite deck 504. Next, as shown in FIG. 35B, fire proofing 500 and/or acoustic spray 501 may be applied to composite deck 504 with z-shaped brackets 93 already attached. Finally, as shown in FIG. 35C, metal studs 14 may be connected toe z-shaped brackets 93 via track 502. Track 502 may be a 20 gage track or a 16 gage track in select embodiments of the instant disclosure.

Figure 36:
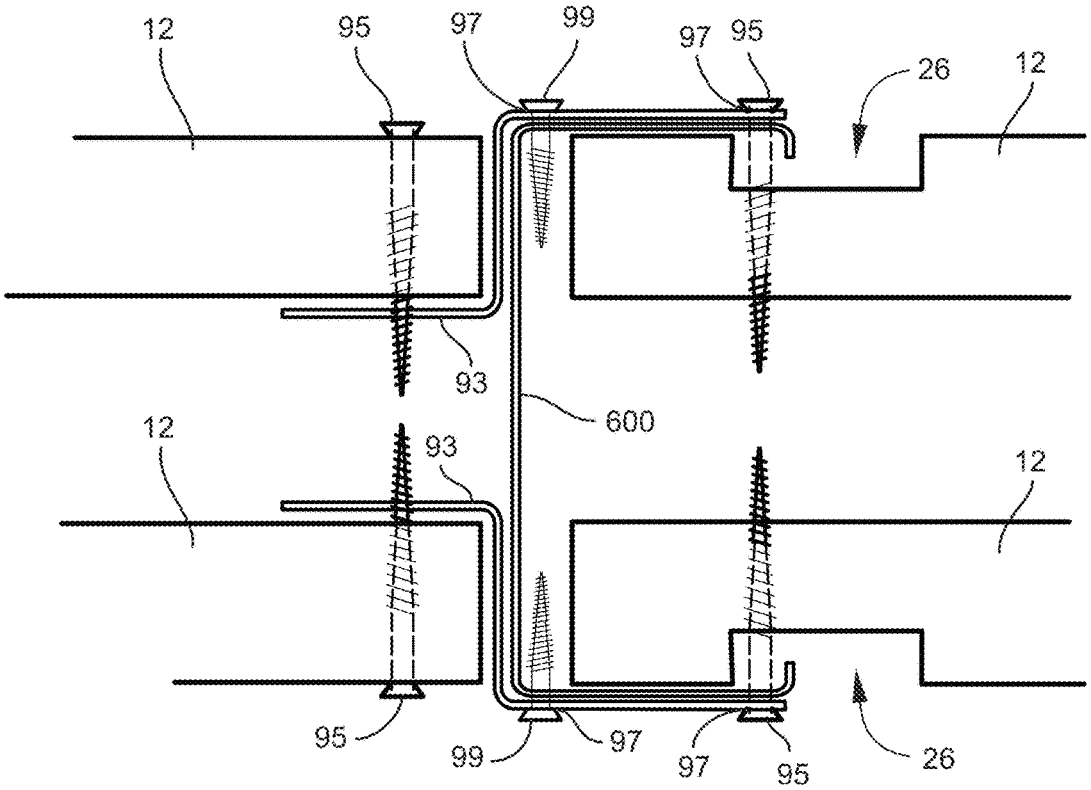
FIG. 36 shows a diagram of wood blocking being attached back to back to a 3⅝ inch metal stud via 2 z-shaped brackets according to select embodiments of the instant disclosure.

Referring now specifically to FIG. 36, a diagram is shown of wood blocking 12 being attached back to back to a 3⅝ inch metal stud 600 according to select embodiments of the instant disclosure. As shown in the Figure, this is done via 2 z-shaped brackets 93 where the wood blocking 12 is attached back to back with a space in the middle.

Figure 37:
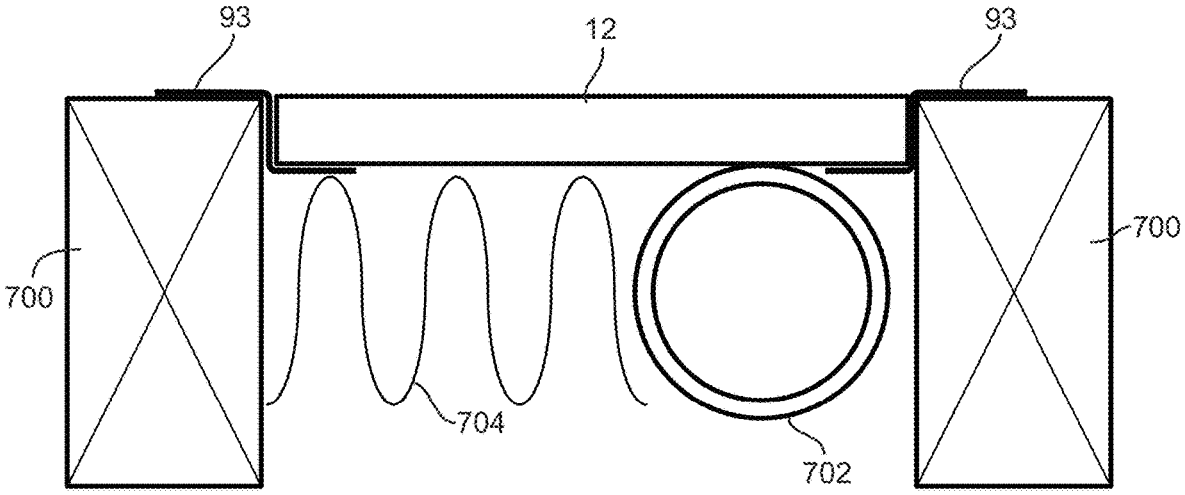
FIG. 37 shows a diagram of wood blocking being attached between wood studs with the disclosed z-shaped bracket according to select embodiments of the instant disclosure, where the insulation and/or 2 inch plumbing pipe is not compressed behind the wood blocking.

Referring now specifically to FIG. 37, a diagram of wood blocking 12 being attached between wood studs 700 with z-shaped brackets 93 is shown according to select embodiments of the instant disclosure. As shown in this Figure, the wood blocking 12 can be attached to the wood studs 700 where insulation 704 and/or 2 inch plumbing pipe 702 (or the like) is not compressed behind wood blocking 12.

Figure 38A:
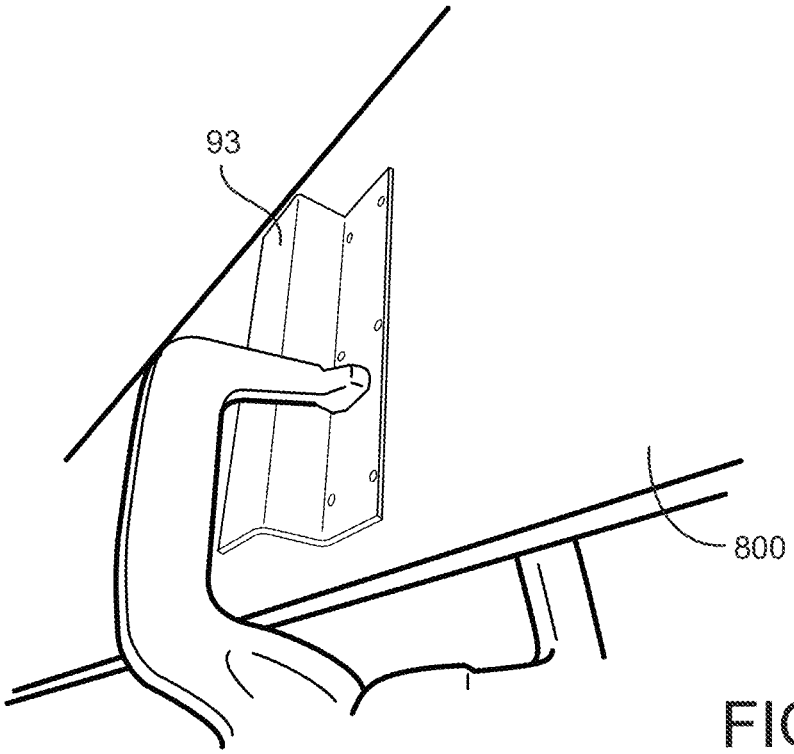
FIGS. 38A and 38B show a diagram of metal studs being attached to a wide flange beam (I-beam) coated with fire proofing and/or acoustic spray via the disclosed z-shaped bracket according to select embodiments of the instant disclosure, where in FIG. 38A the z-shaped bracket is first being shown attached to the naked wide flange beam (I-beam), and then in FIG. 38B, the metal stud is shown attached to the coated wide flange beam (I-beam) via attachment of a track to the z-shaped bracket.
Figure 38B:
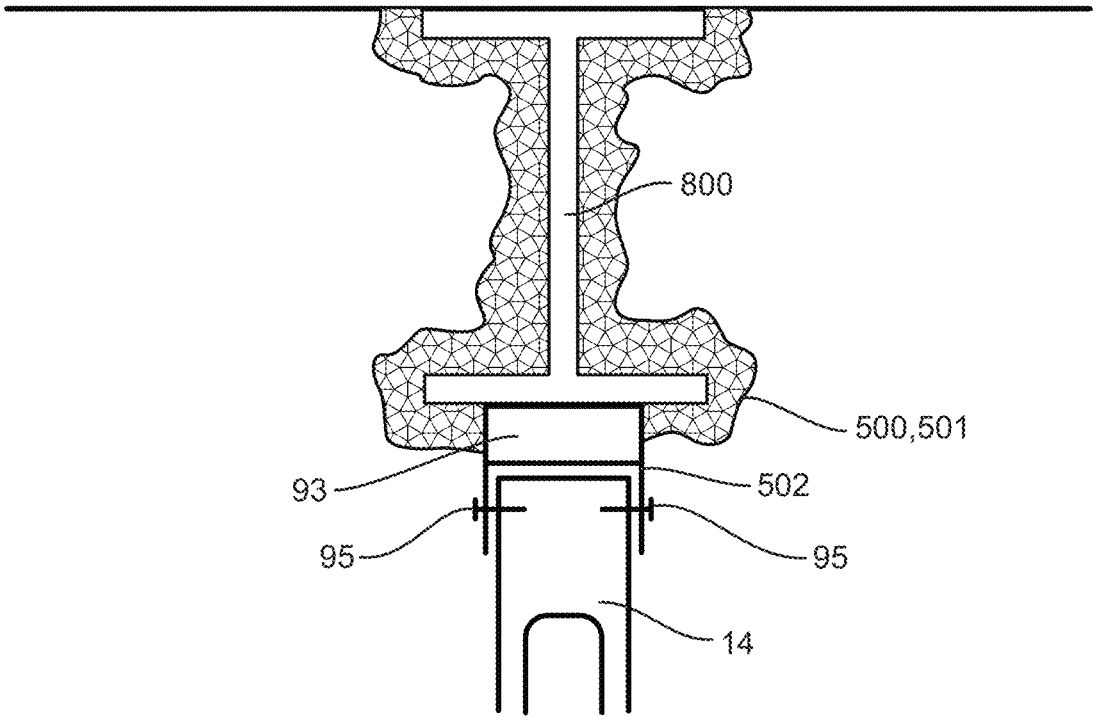

Referring now specifically to FIGS. 38A and 38B, a diagram of metal studs 14 being attached to a wide flange beam (I-beam) 800 coated with fire proofing 500 and/or acoustic spray 501 via z-shaped brackets 93 is shown according to select embodiments of the instant disclosure. As shown in FIG. 38A, z-shaped bracket 93 is first attached to the naked wide flange beam (I-beam) 800. After the z-shaped bracket 93 is attached to the naked wide flange beam (I-beam) 800, then the beam can be coated with fireproofing 500 and/or acoustic spray 501. Finally, as shown in FIG. 38B, the metal stud 14 is attached to the coated wide flange beam (I-beam) 600 via attachment of track 502 to z-shaped bracket 93.

In sum, the present disclosure is directed to a light gauge metal 330 z-shaped bracket 93 for attaching blocking/backing 23 to the following, and/or the like: Cold formed metal Studs (both drywall and structural) Metal Z furring; and Metal Hat channel, Metal drywall Ceiling Grid, RC-1 Channel. The single stamped light gauge metal Z-shaped bracket 93 has holes 97 punched therein for attachment to studs 14.

A feature or advantage of the present disclosure may be its ability to pre-install z-shaped bracket 93 with fasteners 99 thru first vertical row 318 of holes 97 so that z-Shaped Bracket 93 can be installed prior to wood blocking/backing 12 and the result is no interference with the fastener/screw 99 and subsequent installation of the blocking/backing 12.

Another feature or advantage of the present disclosure may be that the second vertical row 320 of holes 97 may allow for simultaneous installation of the Z-Shaped Bracket and the blocking/backing 12 (under soft side 30 of metal stud 14).

Another feature or advantage of the present disclosure may be that the multiple holes 97 in first vertical row 318 and second vertical row 320 may increase pull out strength 328 and shear strength 326 of the blocking/backing 12.

Another feature or advantage of the present disclosure may be that the z-Shaped brackets 93 can be lapped over one another to align the holes and increase the number of fasteners, thus, increasing the shear strength 326 and pullout strength 328 of the blocking 12.

Another feature or advantage of the present disclosure may be that holes 97 can be aligned so that the z-shaped bracket 93 occurs on both sides of the stud for a single fastener per overlapping holes 97 (as shown in FIG. 30).

Another feature or advantage of the present disclosure may be that the z-shaped brackets 93 can be used panel 12 to panel 12 (as shown in FIG. 28), whereas the panel 12 is the blocking/backing 12 for alignment added composite strength, and when the panel to panel prevents clamping or holding with the hand.

Another feature or advantage of the present disclosure may be that the z-shaped bracket 93 can be screwed thru the web (connecting web surface 304) of the z-shaped bracket 93 and into the web of the stud 14 (hard side 36 of stud 14) so as to increase the pull-out value of the blocking by creating a shear value at the z-shaped bracket 93 to stud 14 attachment.

Another feature or advantage of the present disclosure may be that the z-shaped bracket 93 can be screwed to an overhead metal deck or shot to a concrete structure or welded to a beam to allow for an offset equal to the depth/thickness of cementitious fireproofing prior to install of a top track of metal stud framing.

Another feature or advantage of the present disclosure may be that the z-shaped bracket 93 can be bent so that slightly acute angle 334 from the flange surfaces (300 and 302) to the connecting web surface 304 is at a slightly acute angle (like 98 degrees) so as not to allow interference of the square edge 336 of blocking 12 at the radius bend 338 of the z-shaped bracket 93.

Another feature or advantage of the present disclosure may be that the holes 97 of first vertical row 318 (closest to the web of the z-shaped bracket) orientates the fastener/screw in metal stud 14 (as stated in first feature/advantage above) to not create interference. This also intern allows the backing 12 to but to the shaft of the fastener/screw 99. This may realign the studs 14 that may not be on center due to inadequate framing, bent from cold forming, etc. Thus, the sheathing panels will install correctly when installed vertically (See USG, National Gyp).

Another feature or advantage of the present disclosure may be that the punched holes 97 in first flange surface 300 may eliminate or reduce the need for clamping of the z-shaped bracket 93 to the stud 14 thus saving labor and equipment cost. This punched holes 97 may also act as a guide to prevent the screw/fastener from "walking or skating" across the flange of the stud.

Another feature or advantage of the present disclosure may be that the z-shaped bracket 93 can be sandwiched between 2 layers of blocking 12 or backing 12 allowing for increased depth of blocking and the same z-shaped bracket 93 to be used, as shown in FIG. 29.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

The invention claimed is:

1. A wood blocking system including wood blocking placed between metal studs, the wood blocking system comprising:

a panel of a blocking material having a standard width, the standard width of the panel of the blocking material is sized to a nominal stud width configured to fit between the metal studs;

the metal studs including a first metal stud and an adjacent metal stud;

each of the first metal stud and the adjacent metal stud are c-channel metal studs including a hard side including a flat web;

a z-shaped bracket including:

a bracket having a first flange surface, a second flange surface and a connecting web surface;

the first flange surface has a plurality of holes therethrough, wherein the plurality of holes are punched through the first flange surface, where the plurality of holes are configured for pre-installing the bracket on one of the metal studs, where the first flange surface is positioned on an outer flange of the metal stud, the connecting web surface is positioned against the hard side of the metal stud, and the second flange surface extends approximately perpendicular from the hard side of the metal stud, where the second flange surface is configured for attachment to the wood blocking, wherein the plurality of holes through the first flange surface include:

a first vertical row of the holes positioned approximate a web side of the first flange surface; and a second vertical row of the holes positioned approximate a distal side of the first flange surface;

wherein, the combination of the first vertical row of the holes and the second vertical row of the holes is configured for increasing shear strength and pullout strength of the wood blocking;

the connecting web surface connects the first flange surface and the second flange surface at an offset distance, where the second flange surface is parallel with the first flange surface and is offset the offset distance from the first flange surface;

the offset distance of the connecting web surface is approximately a thickness of the wood blocking;

the first flange surface is oriented at a slightly acute angle to the connecting web surface; and the second flange surface is oriented at the slightly acute angle to the connecting web surface;

where the slightly acute angle between the connecting web surface and the first flange, and the slightly acute angle between the connecting web surface and the second flange surface is 89 degrees;

whereby, a combination of the first flange surface, the connecting web surface and the second flange surface create a z-shape configured to prevent interference of a square edge of the blocking at a radius bend of the z-shaped bracket;

wherein, the z-shaped bracket is configured to secure the panel of blocking material between the metal studs.

* * * * *